US007928931B2

(12) United States Patent
Cho et al.

(10) Patent No.: US 7,928,931 B2
(45) **Date of Patent: *Apr. 19, 2011**

(54) PLASMA DISPLAY APPARATUS

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 879 days.

This patent is subject to a terminal disclaimer.

(21) Appl. No.: 11/854,257

(22) Filed: Sep. 12, 2007

(65) Prior Publication Data

US 2008/0062086 A1 Mar. 13, 2008

(30) Foreign Application Priority Data

Sep. 12, 2006 (KR) ..... 10-2006-0088305

(51) Int. Cl.
*G09G 3/28* (2006.01)

(52) U.S. Cl. ..... 345/63; 345/60

(58) Field of Classification Search ..... 345/60–70; 315/169.1–169.4

See application file for complete search history.

(56) References Cited

U.S. PATENT DOCUMENTS

2002/0008680 A1 1/2002 Hashimoto
2005/0264235 A1 12/2005 Ito
2006/0103325 A1 5/2006 Kim

FOREIGN PATENT DOCUMENTS

EP 1 580 714 A2 9/2005

*Primary Examiner* — Ricardo L Osorio
(74) *Attorney, Agent, or Firm* — Birch, Stewart, Kolasch & Birch, LLP

(57) ABSTRACT

A plasma display apparatus comprises a plasma display panel, a sustain driver, a data driver and a reference separation controller. The plasma display panel including a first electrode, a second electrode and a third electrode crossing the first electrode and the second electrode. The sustain driver supplying a sustain signal swinging between a positive polarity sustain voltage and a negative polarity sustain voltage to the first electrode during a sustain period. The data driver supplying a data signal to the third electrode during an address period. The reference separation controller controlling a first reference voltage source, which is connected with the sustain driver and the second electrode commonly, separated from or connected with a second reference voltage source which is connected with the data driver.

11 Claims, 22 Drawing Sheets

PLASMA DISPLAY APPARATUS

This nonprovisional application claims priority under 35 U.S.C. §119(a) on Patent Application No. 10-2006-0088305 filed in Republic of Korea on Sep. 12, 2006 the entire contents of which are hereby incorporated by reference.

BACKGROUND

1. Field

This document relates to a plasma display apparatus.

2. Related Art

In general, the plasma display apparatus comprises a plasma display panel (PDP) that displays images and a driver attached on a rear surface of the PDP to drive the PDP.

In the PDP that displays images, a plurality of discharge cells are formed to be divided by barrier ribs between front and rear substrates and filled with an inert gas containing such as neon (Ne), helium (He) or a mixture gas of Ne+He as a primary discharge gas and a small amount of xenon (Xe). Several discharge cells group to form a single pixel. For example, red, green and blue discharge cells form a single pixel.

When a discharge occurs by an RF (Radio Frequency) voltage in the PDP, the inert gas generates vacuum ultraviolet rays and illuminates phosphors formed between the barrier ribs to display images. Because the PDP is thinner and lighter, it receives much attention as a display device.

SUMMARY

In one aspect, a plasma display apparatus comprising a plasma display panel including a first electrode, a second electrode and a third electrode crossing the first electrode and the second electrode; a sustain driver supplying a sustain signal swinging between a positive polarity sustain voltage and a negative polarity sustain voltage to the first electrode during a sustain period; a data driver supplying a data signal to the third electrode during an address period; and a reference separation controller controlling a first reference voltage source, which is connected with the sustain driver and the second electrode commonly, separated from or connected with a second reference voltage source which is connected with the data driver.

In the other aspect, a plasma display apparatus comprising: a plasma display panel including a first electrode; a set-up controller supplying a set-up signal rising from a positive polarity sustain voltage to the first electrode; an energy storage unit supplying a negative polarity sustain voltage; a sustain driver supplying a sustain signal swinging between the positive polarity sustain voltage and the negative polarity sustain voltage to the first electrode.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to the attached drawings.

Exemplary embodiments of the present invention will now be described with reference to the accompanying drawings.

Figure 1:
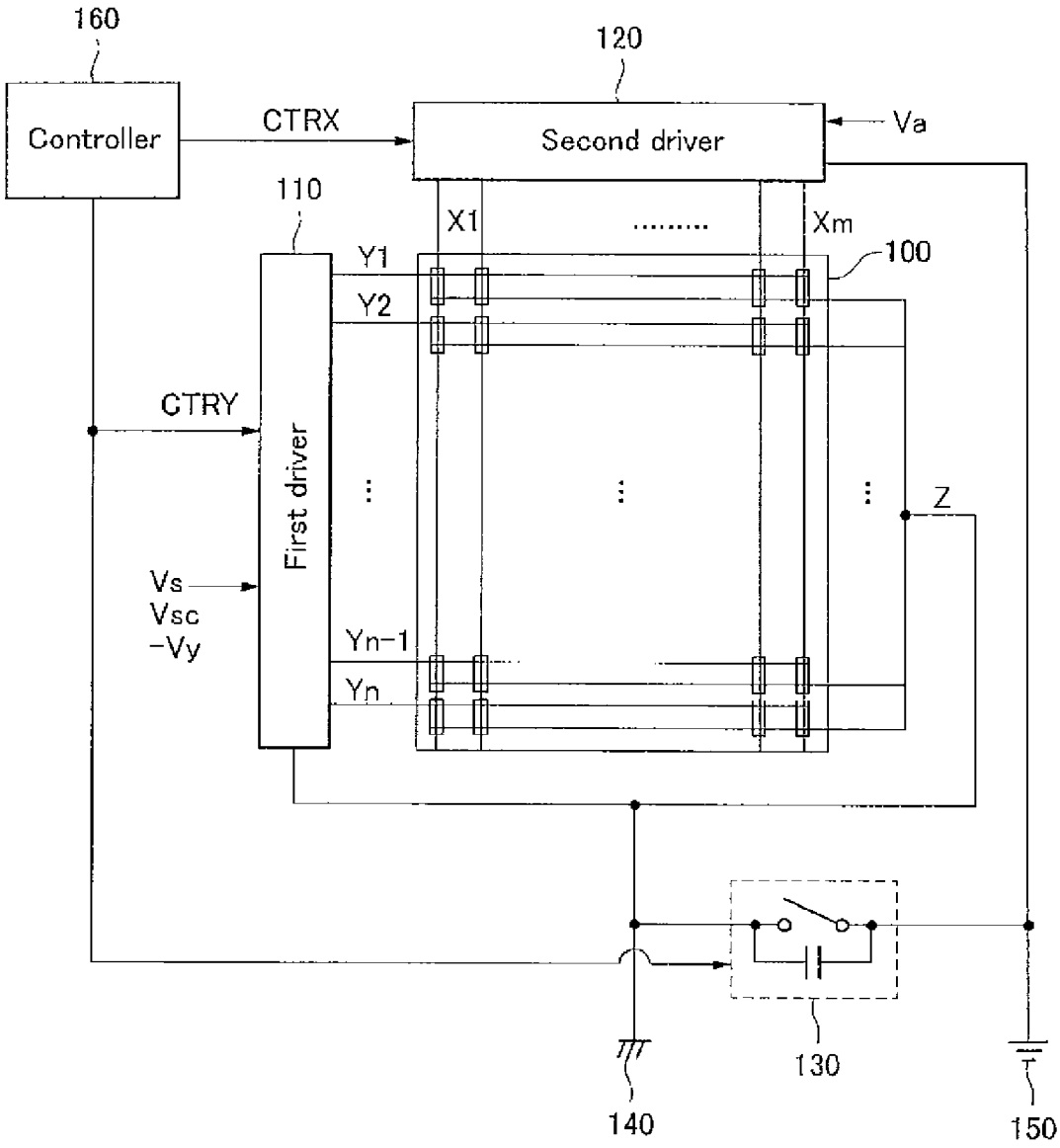
FIG. 1 is a view illustrating an example of a plasma display apparatus to which this document is applied.

FIG. 1 is a view illustrating an example of a plasma display apparatus to which this document is applied.

With reference to FIG. 1, the plasma display apparatus according to an exemplary embodiment of the present invention comprises a plasma display panel (PDP) 100, a first driver 110, a second driver 120, a reference separation controller 130, and a controller 160.

The PDP 100 comprises first electrodes Y1~Yn, second electrodes Z, and third electrodes X1~Xm disposed to cross the first electrodes Y1~Yn and the second electrodes (Z). The first electrodes Y1~Yn of the PDP 100 are electrically connected with the first driver 110, and the second electrodes (Z) and the first driver 110 are electrically connected with a first reference voltage source 140. The third electrodes X1~Xm are connected with the second driver 120, and the second driver 120 is electrically connected with a second reference voltage source 150.

The reference separation controller 130 is electrically connected between the first and second reference voltage sources 140 and 150.

The first driver 110 comprises a setup controller and a sustain driver, and the second driver 120 comprises a data driver. The first driver 110 drives the first electrodes Y1~Yn of the PDP 100.

The setup controller of the first driver 110 receives a voltage from a positive polarity sustain constant voltage source during a set-up period of a reset period and supplies a set-up signal that rises from a positive polarity sustain voltage to the first electrodes Y.

The sustain driver of the first driver 110 supplies a sustain signal causing a sustain discharge to the plurality of first electrodes Y1~Yn. The sustain signal swings between the positive polarity sustain voltage and a negative polarity sustain voltage.

The first driver may supply a set-down signal to the first electrodes Y1~Yn so that wall charges can be uniformly formed within discharges cells, and also supply a scan reference voltage or a scan signal.

Voltage sources of the first driver 110 supply voltages based on the first reference voltage source 140. For example, the voltage sources such as a sustain voltage source for supplying a voltage of a sustain signal, a set-up voltage source for supplying a set-up signal of a reset signal, etc., supply a voltage with a suitable size to the first driver 110 based on the first reference voltage source 140.

The first reference voltage source 140 supplies a first reference voltage, is made of an electroconductive material, and has a certain area. For example, the first reference voltage source 140 may be a frame, may comprise a copper foil with a certain area while being separated from the frame spatially and electrically, or may comprise an electroconductive material attached on a case of the plasma display apparatus.

The second driver 120 comprises the data driver, and the data driver supplies a data signal to the plurality of third electrodes X1~Xm of the PDP 100 during an address period. A data voltage source that supplies a maximum voltage of the data signal supplies a data voltage based on the second reference voltage source 150. The second reference voltage source 150 is spatially and electrically separated from the first voltage reference source 140.

The second reference voltage source 150 may be other ones than the first reference voltage source 140 among the above-described examples. For example, when the first reference voltage source 140 is the frame, the second reference voltage source 150 may be the copper foil.

The reference separation controller 130 controls the first reference voltage source 140 connected with the sustain driver and the second reference voltage source 150 connected with the data driver to be separated or connected. The reference separation controller 130 may comprise a parasitic capacitor of a switch.

While the sustain driver supplies the sustain signal to the first electrodes Y1~Yn during a sustain period, a facing discharge occurs within discharge cells. In this case, the reference separation controller 130 electrically separates the first reference voltage source 140 of the sustain driver and the second reference voltage source 150 of the data driver to generate a voltage difference between the first and second reference voltage sources 140 and 150 and form a floating voltage in the third electrodes X1~Xm according to a change in the sustain signal. Thus, the facing discharge can be restrained by the floating voltage of the third electrodes X1~Xm and damage to phosphors that may be caused by the facing discharge can be prevented. In addition, the life span of the drivers of the plasma display apparatus can be lengthened.

The controller 160 controls the switching elements included in the first and second drivers 110 and 120 and the reference separation controller 130.

Figure 2:
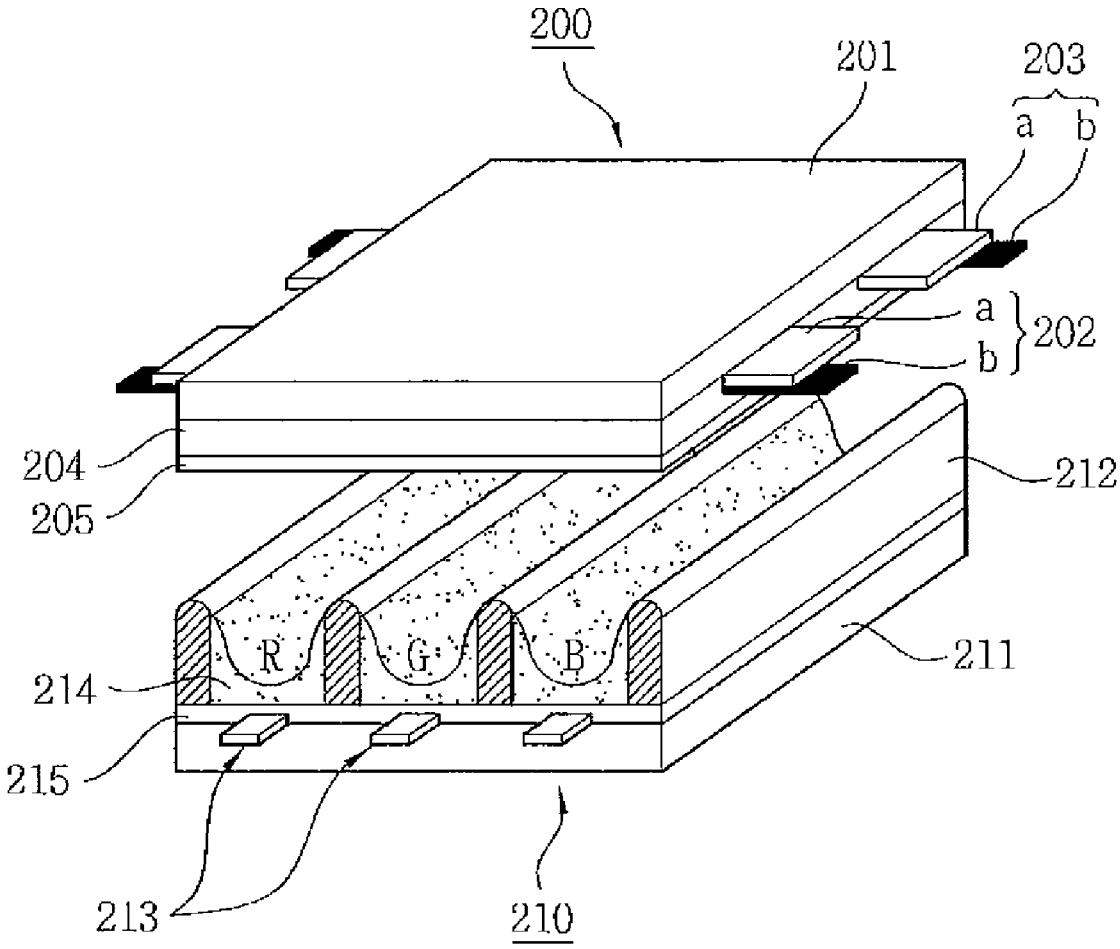
FIG. 2 is a view illustrating an example of the structure of a plasma display panel (PDP) in FIG. 1.

With reference to FIG. 2, the PDP 100 comprises a front panel 200 constructed such that the first electrodes 202 (Y) and the second electrodes 203 (Z) are formed to maintain discharges on a front substrate 201, a display surface on which images are displayed, and a rear panel 210 constructed such that a plurality of third electrodes 213 (X) are arranged to cross the first electrodes 202 (Y) and the second electrodes 203 (Z) on a rear substrate 211. The front and rear panels 200 and 210 are attached with a certain gap therebetween.

The front panel 200 comprises the first electrodes 202 (Y) and the second electrodes 203 (Z) that perform mutual discharges in a single discharge space, namely, in a single discharge cell, and maintain illumination of the discharge cell. The sustain electrodes may include the first electrodes 202 (Y) and the second electrodes 203 (Z) as pairs, each comprising a transparent electrode (a) made of a transparent ITO material and a bus electrode (b) made of a metallic material. The first electrodes 202 (Y) and the second electrodes 203 (Z) may be covered by an upper dielectric layer 204 (or dielectric layers) that limits a discharge current and insulates the pairs of electrodes. A protection layer 205 may be formed by depositing magnesium oxide (MgO) on an upper surface of the upper dielectric layer 204 in order to facilitate discharge conditions.

On the rear panel 210, there may be arranged barrier ribs 212 in a stripe type (or a well type), forming the plurality of discharge spaces, namely, the discharge cells. In addition, the plurality of third electrodes 213 (X) may be disposed to be parallel with the barrier ribs 212 and perform address discharges to generate vacuum ultraviolet rays. R, G, and B phosphors 2124 are coated on the upper surfaces of the rear panel 210 in order to emit visible rays for displaying images during the address discharges. A lower dielectric layer 215 may be formed between the third electrodes 213 (X) and the phosphors 214 in order to protect the third electrodes 213 (X).

FIG. 2 shows only an example of the PDP and the present invention is not limited thereto.

For example, in the PDP as shown in FIG. 2, the first electrodes 202 (Y) and the second electrodes (Z), the sustain electrodes, comprise the transparent electrodes 202*a* and 203*a* and the bus electrodes 202*b* and 203*b*, respectively. But alternatively, one or more of the first electrodes 202 (Y) and the second electrodes 203 (Z) may comprise only the bus electrodes 202*b* and 203*b*.

In addition, for example, the upper dielectric layer 204 as shown in FIG. 2 has the uniform thickness, but it may have different thickness and dielectric constants by regions. Also, intervals of the barrier ribs 212 as shown in FIG. 2 are uniform, but the space between the barrier ribs 212 of the discharge cell 'B' may be wider.

Moreover, the side surfaces of the barrier ribs 212 may have a depressed (Intaglioed) and raised (embossed) pattern and the phosphor layer 214 is coated thereon accordingly, thereby enhancing luminance of an image displayed on the PDP.

A tunnel may be formed at the side of the barrier ribs 212 in the process of fabricating the PDP in order to improve exhaust characteristics.

Figure 3:
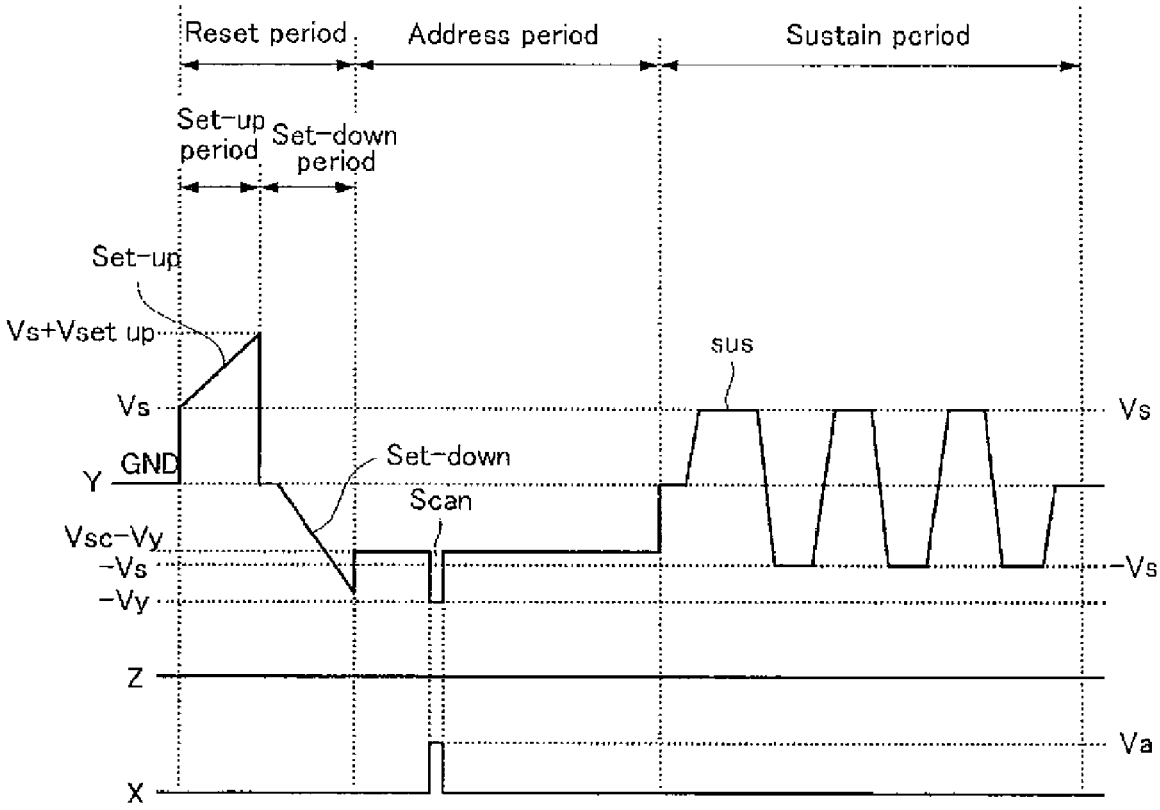
FIG. 3 is a view illustrating a method of driving the PDP in FIG. 1.

With reference to FIG. 3, the drivers 110 and 120 in FIG. 1 supply drive signals to the first electrodes (Y) and the third electrodes (X) during one or more of the reset period, the address period, and the sustain period. Because the second electrodes (Z) are electrically connected with the first reference voltage source 140, the second electrodes (Z) receive a voltage of the first reference voltage source 140 during the reset period, the address period and the sustain period.

As shown in FIG. 3, a set-up controller of the first driver 110 may supply the set-up signal to the first electrodes (Y) during the set-up period of the reset period.

A weak dark discharge occurs within the discharge cells of the entire screen according to the set-up signal (Set-up). According to the set-up discharge, positive polarity wall charges are accumulated in the third electrodes (X) and the second electrodes (Z), and negative polarity wall charges are accumulated in the first electrode (Y).

In addition, after supplying a set-down signal (Set-down) to the first electrodes (Y) during a set-down period of the reset period, a set-down controller of the first driver 110 may supply a set-down signal (Set-down) that starts to fall from a positive polarity voltage lower than a maximum voltage of the set-up signal (Set-up) to a particular voltage level below a ground level voltage (GND). Accordingly, a weak erase discharge occurs within the discharge cells to sufficiently erase the wall charges which have been excessively formed within the discharge cells. Due to the set-down discharge, wall charges, that allow stable address discharge to occur, can remain uniformly in the discharge cells.

A scan reference voltage controller of the first driver 110 may supply a scan bias voltage Vsc−Vy during the address period, and a scan signal controller of the first driver 110 may supply a negative scan signal that falls from the scan bias voltage Vsc−Vy to a minimum voltage −Vy of the scan signal to the first electrodes (Y). The data driver of the second driver 120 supplies a positive polarity data signal to the third electrode, which corresponds to the scan signal.

As the voltage difference between the scan signal and the data signal and the wall voltage generated during the reset period are added, an address discharge occurs within the discharge cells to which the data signal is applied. Wall charges, that are sufficient to allow discharge to occur when the sustain voltage Vs is applied, are formed within the discharge cells selected by the address discharge. Accordingly, the first electrodes (Y) are scanned.

The sustain driver of the first driver 110 supplies the sustain signal SUS that swings between the positive polarity sustain voltage Vs and the negative polarity sustain voltage −Vs to the first electrodes (Y).

Accordingly, as the wall voltage within the discharge cells and the sustain signal SUS are added, a sustain discharge, namely, a display discharge, occurs between the first and second electrodes Y and Z in the discharge cells which have been selected by the address discharge.

The above-described driving method shows one example and an erasing period may be added.

Herein, the drive signals as shown in FIG. 3 have been described, but only a scan reference voltage Vsc higher than the voltage of the ground level, instead of the scan bias voltage Vsc−Vy lower than the voltage of the ground level, may be supplied during the address period.

Figure 4:
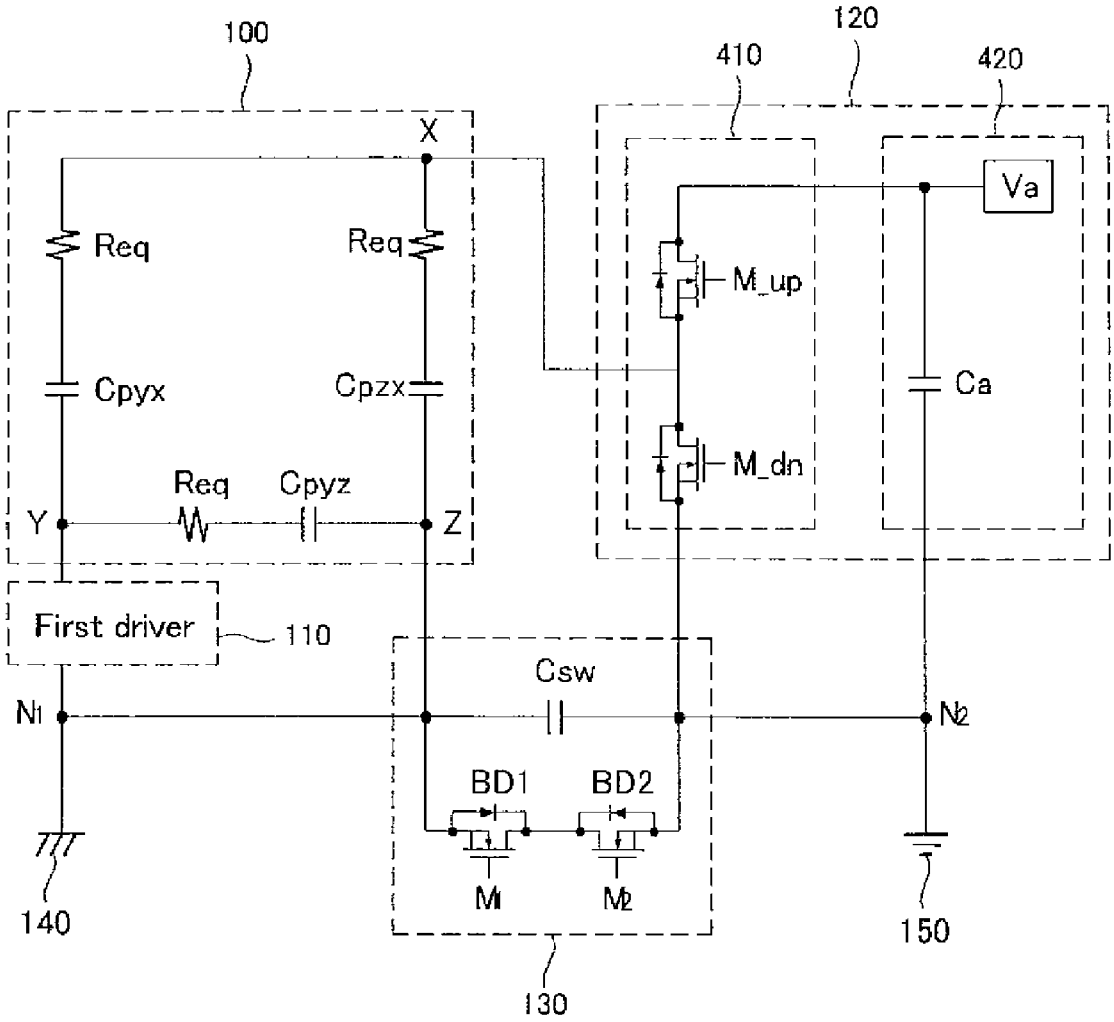
FIG. 4 is a view illustrating a first driver, a second driver, and a reference separation controller in FIG. 1.

As shown in FIG. 4, a YZ capacitor Cpyz is an equivalent capacitor between the first and second electrodes Y and Z. A ZX capacitor Cpzx is an equivalent capacitor between the second and third electrodes Z and X. A YX capacitor Cpyx is an equivalent capacitor between the third and first electrodes X and Y. Reqs are equivalent resistors of the respective electrodes X, Y, and Z.

The first driver 110 is connected with the first electrodes (Y) of the PDP 100, and also connected with the first reference voltage source 140, the second electrodes (Z) of the PDP 100, and one end of the reference separation controller 130.

The first driver 110 comprises the set-up controller and the sustain driver. The set-up controller and the sustain driver will be described with reference to FIG. 5 and other drawings.

The second driver 120 is connected with the third electrodes (X) of the PDP 100 and is commonly connected with the second reference voltage source 150 and the other end of the reference separation controller 130. The second driver 120 comprises a data driver 410.

The data driver 410 comprises a top switch M_up and a bottom switch M_dn. One end of the top switch M_up is connected with the third electrodes (X) and the other end of the top switch M_up is connected with a data constant voltage source 420. A data voltage Va of the data constant voltage source 420 is supplied to the third electrodes (X) according to an operation of the top switch M_up. One end of the bottom switch M_dn is commonly connected with the third electrodes (X) and one end of the top switch M_up, and the other end of the bottom switch M_dn is commonly connected with the reference separation controller 130 and the other end of the second reference voltage source 150. A second reference voltage supplied from the second reference voltage source 150 is supplied to the third electrodes (X0 according to an operation of the bottom switch M_dn.

Power supplied to the data driver 410 may be connected with the second reference voltage source 150 via a data constant voltage capacitor Ca of the data driver 410. One end of the data constant voltage capacitor Ca is commonly connected with the data constant voltage source 420 and the other end of the top switch M_up, and the other end of the data constant voltage capacitor Ca is commonly connected with the other end of the bottom switch M_dn, the second reference voltage source 150, and the other end of the reference separation controller 130.

The reference separation controller 130 comprises reference separation switches M1 and M2, and may comprise a parasitic capacitor Csw that is parasitic on the reference separation switches M1 and M2. The reference separation switches M1 and M2 may comprise body diodes BD1 and BD2, respectively, and anodes of the body diodes BD1 and BD2 may be mutually connected or cathodes thereof may be mutually connected.

One end of the reference separation switch M1 is commonly connected with the first reference voltage source 140 and the second electrodes (Z0, and the other end of the reference separation switch M2 is connected with the second reference voltage source 150, the other end of the bottom switch M_dn, and the data constant voltage source 420. The first and second reference voltage sources 140 and 150 may be separated according to an operation of the reference separation switches M1 and M2.

When the reference separation controller 130 separates the first and second reference voltage sources 140 and 150, the third electrodes (X) fall into a floating state. Why the third electrodes (X) fall into the floating state is because when the reference separation controller 130 electrically separates the first and second reference voltage sources 140 and 150, the voltage of the third electrodes (X) is affected by the voltage of the first electrodes (Y) and the voltage of the second electrodes (Z) and changed.

For example, when the reference separation controller 130 separates the first and second reference voltage sources 140 and 150 and the first driver 110 supplies a first voltage to the first electrodes (Y) based on the first reference voltage source 140, the voltage between the first and second electrodes Y and Z becomes the first voltage.

According to the Kirchhof's law (KVL), the sum of the voltage between the first and third electrodes Y and X and the voltage between the third and second electrodes X and Z is the same as the voltage between the first and second electrodes Y and Z, which is, namely, the first voltage.

In the PDP 100, the equivalent capacitor Cpyz between the first and second electrodes Y and Z, the equivalent capacitor Cpyx between the first and third electrodes Y and X, and the equivalent capacitor Cpzx between the third and second electrodes X and Z have the substantially same values. Accordingly, so long as a different voltage is not supplied to the third electrodes (X) of the PDP 100 from the external or so long as a current path through which the voltage of the third electrodes (X) is supplied to the exterior is not formed, the third electrodes (X) float. Thus, the voltage of the third electrodes (X) in the floating state is affected by the voltage supplied to the equivalent capacitor Cpyz between the first and second electrodes Y and Z, so the voltage of the third electrodes (X) is smaller than or the same as the voltage which has been supplied to the equivalent capacitor Cpyz between the first and second electrodes Y and Z.

In this case, because the voltage level of the second electrodes (Z) is the same as that of the first reference voltage source 140, the voltage of the third electrodes (X) is affected by the voltage of the first electrodes (Y).

Figure 5:
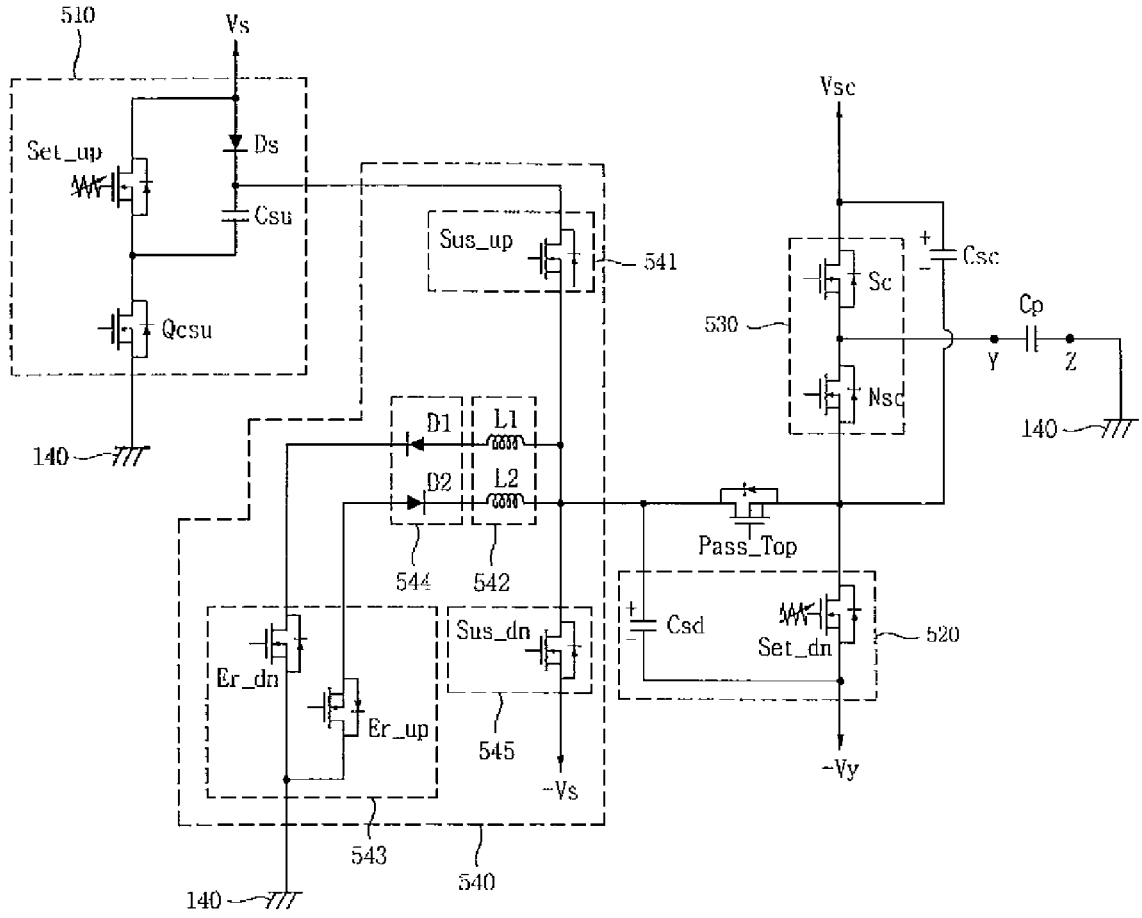
FIG. 5 is a view illustrating an example of the first driver in FIG. 4.

As shown in FIG. 5, the first driver 110 comprises a set-up controller 510, a set-down controller 520, a drive signal output unit 530, and a sustain driver 540.

The set-up controller 510 comprises a set-up switch Set_up that receives a voltage from the positive polarity sustain voltage source Vs and supplies a set-up signal that rises from the positive polarity sustain voltage Vs to a certain voltage during the set-up period of the reset period, a set-up diode Ds that provides a current path of the positive polarity sustain voltage +Vs, a set-up capacitor Csu that charges the positive polarity sustain voltage +Vs of the set-up signal Set-up, and a set-up charge switch Qcsu that controls charging of voltage of the set-up capacitor Csu.

One end of the set-up switch Set_up is commonly connected with the positive polarity sustain voltage source +Vs and one end of the set-up diode Ds, and the other end of the set-up switch Set_up is commonly connected with one end of the set-up charge switch Qcsu and the other end of the set-up capacitor Csu.

One end of the set-up diode Ds is commonly connected with the positive polarity sustain voltage source +Vs and one end of the set-up switch Set_up, and the other end of the set-up diode Ds is connected with one end of the set-up capacitor Csu.

The other end of the set-up charge switch Qcsu is connected with the first reference voltage source 140.

In the set-up controller 510, the set-up charge switch Qcsu is turned to charge the set-up capacitor Csu during a period excluding the set-up period.

Figure 6A:
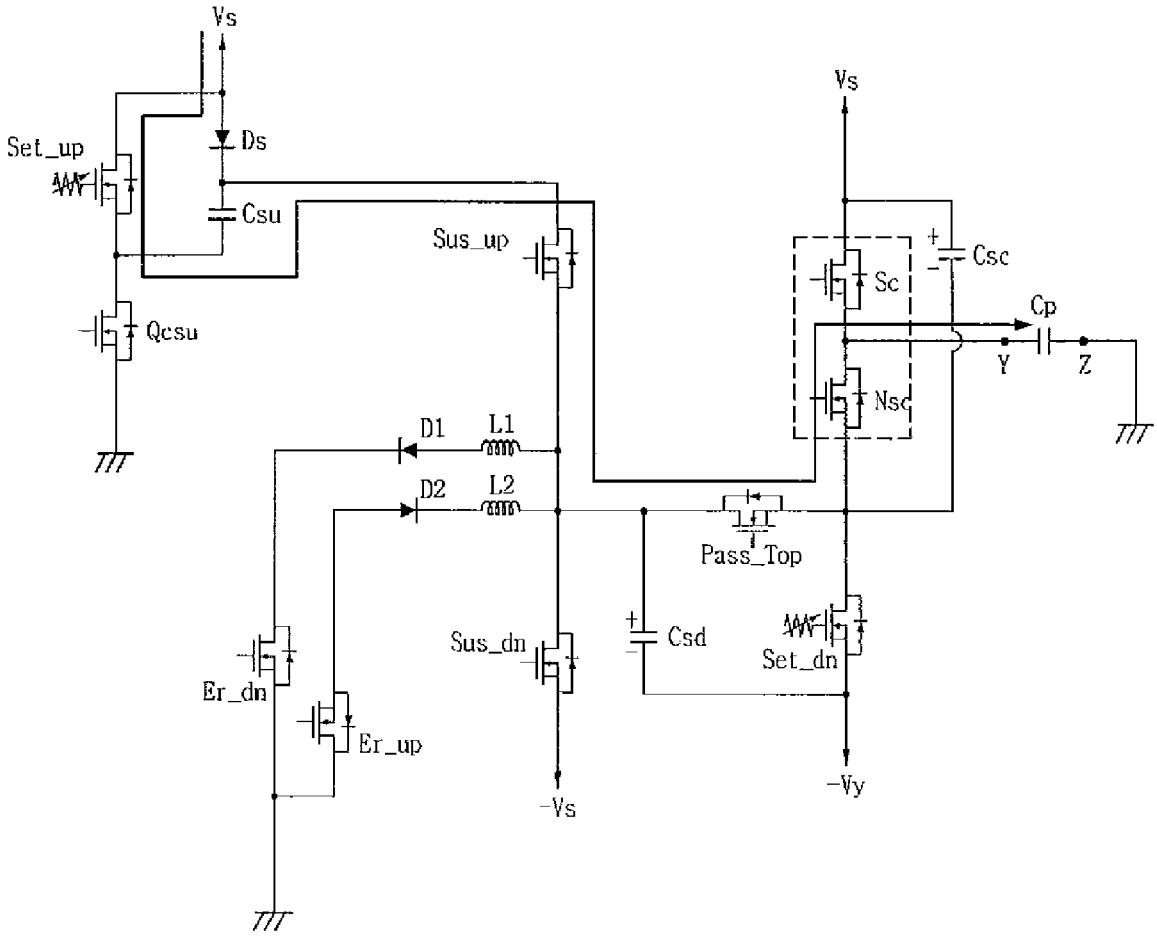
FIGS. 6*a* to 6*i* are views illustrating examples of a method for operating the first driver in FIG. 5.

With the set-up capacitor Csu charged, when the set-up switch Set_up is turned on during the set-up period of the reset period, a current path as shown in FIG. 6*a* is formed. At this time, a first sustain switch Sus_up, a pass top switch Pass_Top, and a non-scan switch Nsc are also turned on.

The set-up controller 510 supplies the set-up signal that rises from the positive polarity sustain voltage Vs as charged in the set-up capacitor Csu to the first electrodes (Y) along the current path as shown in FIG. 6*a*.

In this case, in order to supply the set-up signal to the first electrodes (Y), the set-up controller 510 uses the positive polarity sustain constant voltage source Vs, rather than using any additional set-up constant voltage source, so the number of power sources can be reduced and thus the production cost can be reduced.

The set-down controller 520 comprises a set-down switch Set_dn and a set-down capacitor Csd.

One end of the set-down switch Set_dn is commonly connected with a negative polarity scan constant voltage source −Vy and one end of the set-down capacitor Csd, and the other end of the set-down switch Set_dn is connected with one end of the pass top switch Pass_Top. The other end of the set-down capacitor Csd is connected with the other end of the pass top switch Pass_Top.

Figure 6B:
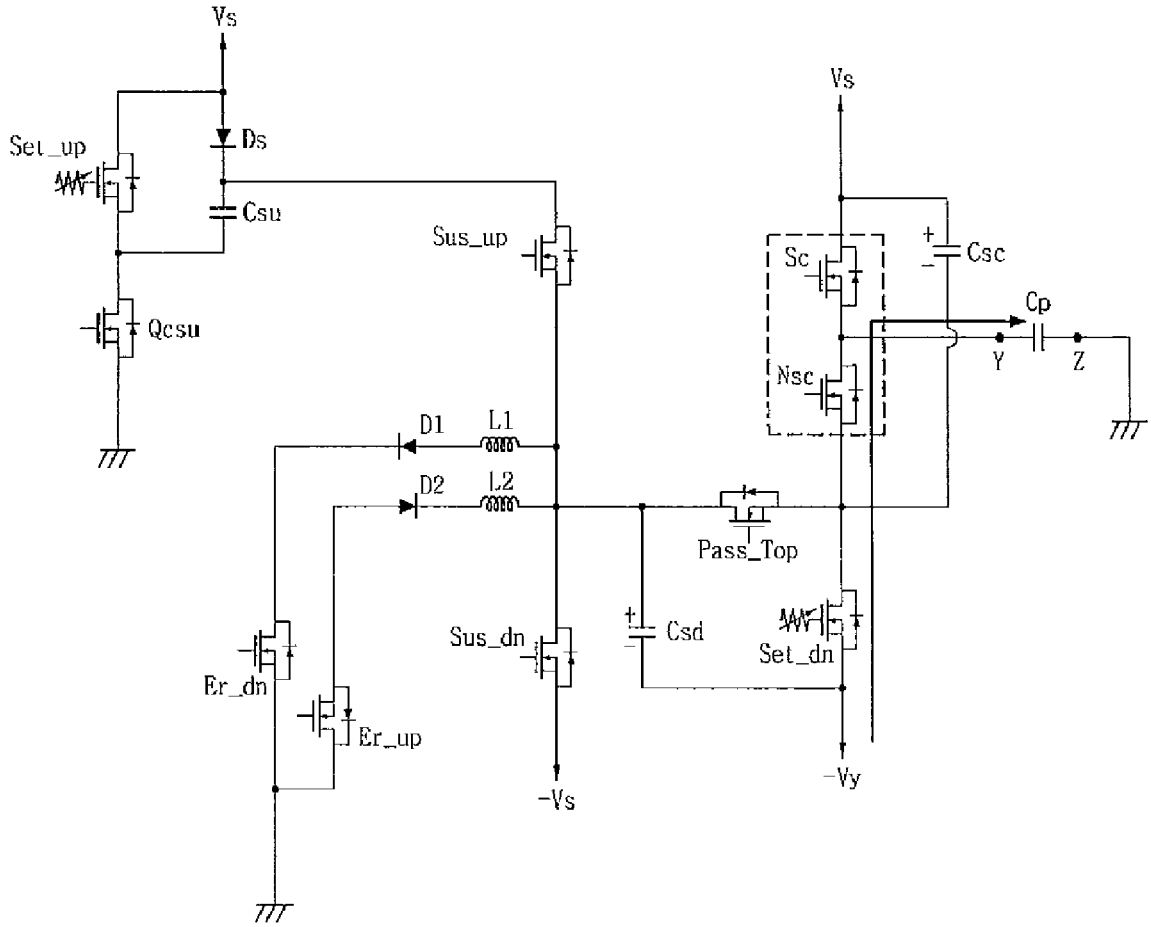

The set-down switch Set_dn of the set-down controller 520 is turned on during the set-down period of the reset period to supply a set-down signal that gradually falls from the voltage of the ground level to the negative polarity scan voltage −Vy to the first electrodes (Y) via the non-scan switch Nsc along the current path as shown in FIG. 6*b*. The set-down controller 520 continuously maintains the ON state until the address period expires after the set-down period.

The drive signal output unit 530 comprises a scan switch Sc and the non-scan switch Nsc. One end of the scan switch Sc is connected with the scan reference voltage source Vsc and the other end thereof is commonly connected with one end of the non-scan switch Nsc and the first electrodes (Y). The other end of the non-scan switch Nsc is connected with the pass top switch Pass_Top.

Figure 6C:
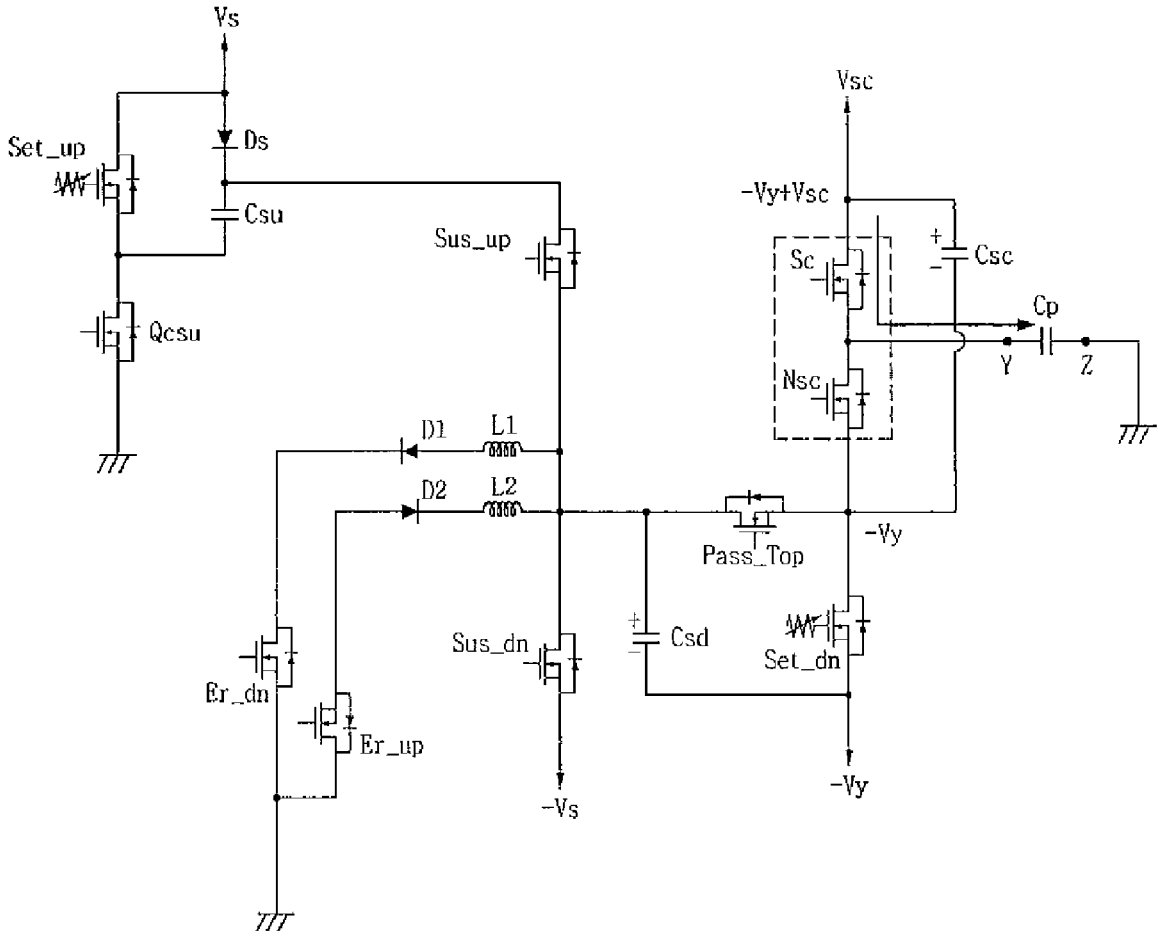

The scan switch Sc of the drive signal output unit 530 is turned on during the address period to supply the voltage −Vy+Vsc, namely, the sum of the negative polarity scan voltage −Vy and the scan reference voltage Vsc, along a current path as shown in FIG. 6*c*. When the scan reference voltage Vsc is charged in the scan capacitor Csd and the negative polarity scan voltage −Vy is supplied to one end of the scan capacitor Csd, the voltage of the other end of the scan capacitor Csd is equivalent to the voltage −Vy+Vsc, namely, the sum of the scan reference voltage Vsc charged in the scan capacitor Csd and the negative polarity scan voltage −Vy, and accordingly, the sum voltage −Vy+Vsc is supplied via the scan switch Sc.

Figure 6D:
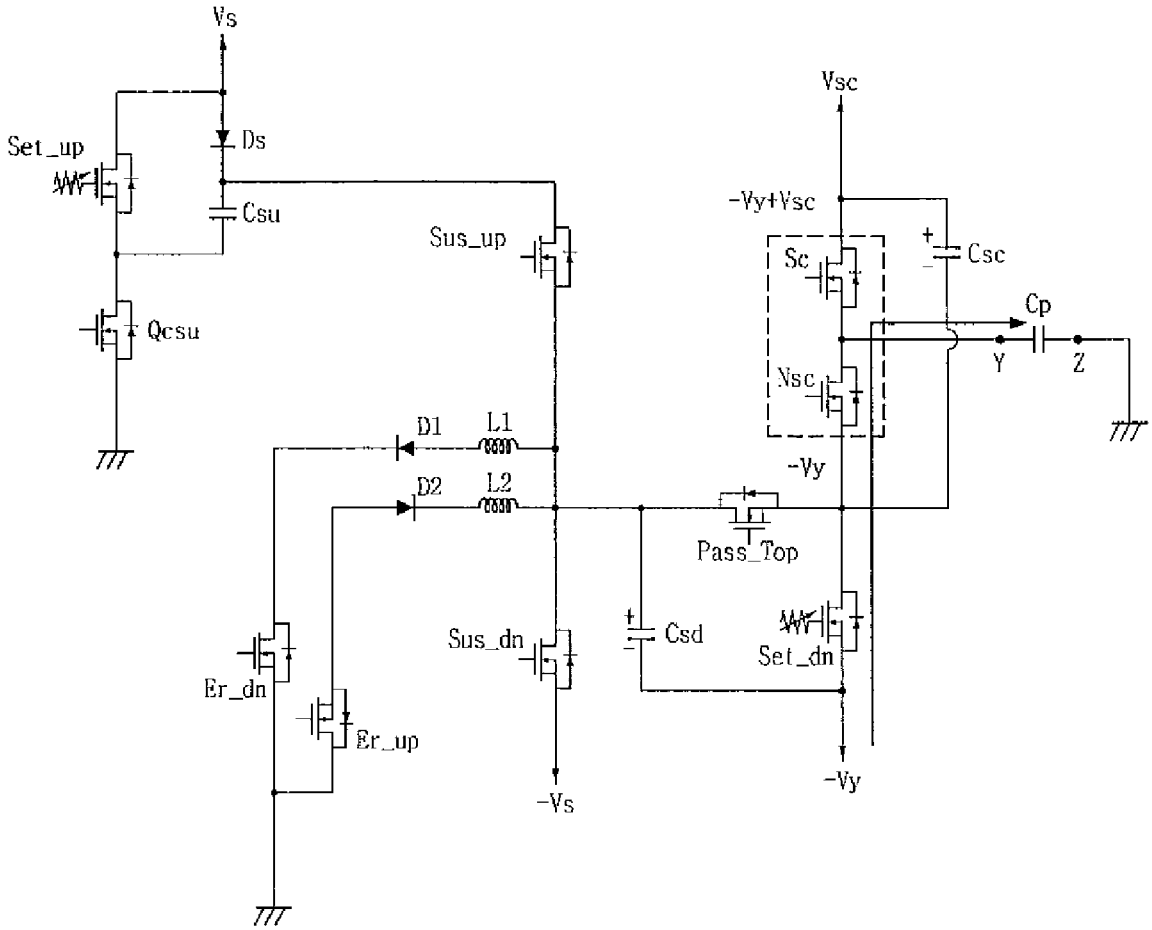

The scan switch Sc is turned off during the address period and the non-scan switch Nsc is turned on to form a current path as shown in FIG. 6*d*, and the scan signal is supplied to the first electrodes (Y). Namely, when the set-down switch Set_dn is turned on during the set-down period, a set-down signal that gradually falls is supplied and the turned on state is continuously maintained during the address period following the set-down period. Thus, when the non-scan switch Nsc is turned on, the negative polarity scan voltage −Vy is supplied to the first electrodes (Y).

Figure 6E:
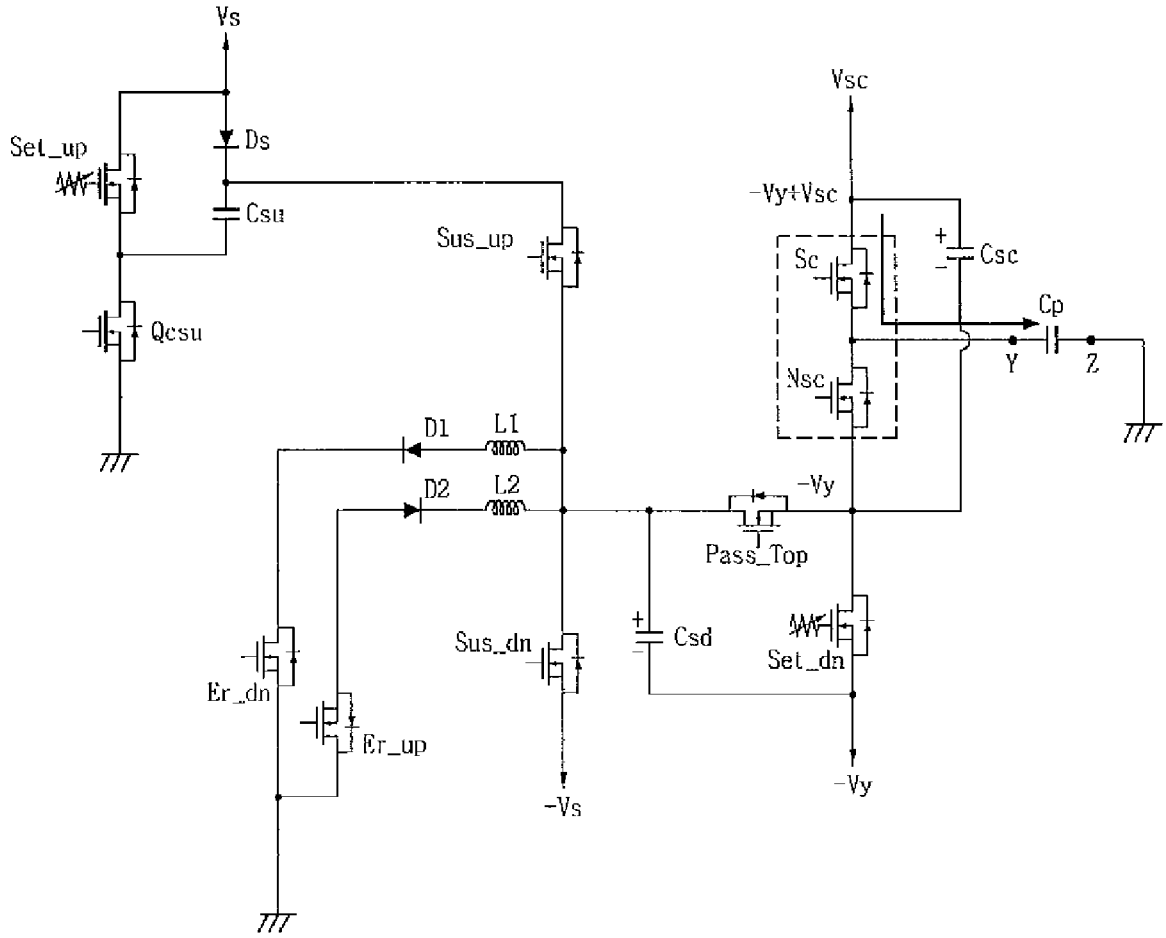

And then, after the scan signal is supplied during the address period, the scan switch Sc is turned on and the non-scan switch Nsc is turned off during a period while the scan bias voltage −Vy+Vsc is to be supplied in order to form a current path as shown in FIG. 6*e*, and the scan bias voltage −Vy+Vsc is supplied to the first electrodes (Y).

As shown in FIG. 5, the sustain driver 540 comprises a first sustain controller 541, an inductor unit 542, a resonance controller 543, a reverse current blocking unit 544, and a second sustain controller 545.

The first sustain controller 541 comprises a first sustain switch Sus_up and supplies the positive polarity sustain voltage Vs supplied from the positive polarity sustain voltage source Vs to the first electrodes (Y).

The inductor unit 542 comprises first and second inductors L1 and L2. One end of the first inductor L1 and one end of the second inductor L2 are connected with the first sustain switch Sus_up. When the first inductor L1 forms resonance with the panel Cp, the voltage of the first electrode (Y) falls from the positive polarity sustain voltage Vs to the negative polarity sustain voltage −Vs. When the second inductor L2 forms resonance with the panel Cp, the voltage of the first electrodes (Y) rises from the negative polarity sustain voltage −Vs to the positive polarity sustain voltage Vs.

The resonance controller 543 comprises a first resonance switch Er_dn and the second resonance switch Er_up which are connected with the first reference voltage source 140. When the first resonance switch Er_dn is turned on, the panel Cp and the first inductor L1 form resonance. Accordingly, the voltage of the first electrodes (Y) falls from the positive polarity sustain voltage Vs to the negative polarity sustain voltage −Vs. When the second resonance switch Er_up is turned on, the panel Cp and the second inductor L2 form resonance. Accordingly, the voltage of the first electrodes (Y) rises from the negative polarity sustain voltage −Vs to the positive polarity sustain voltage Vs.

The reverse current blocking unit 544 comprises first and second blocking diodes D1 and is electrically connected with the inductor unit 542 and the resonance controller 543 to block (cut off) a reverse current. The first blocking diode D1 blocks current that flows from the first resonance switch Er_dn to the first inductor L1, and the second blocking diode D2 blocks current that flows from the second inductor L2 to the second resonance switch Er_up.

The second sustain controller 545 comprises a second sustain switch Sus_dn and supplies the negative polarity sustain voltage −Vs supplied from the negative polarity sustain constant voltage source −Vs.

Figure 6F:
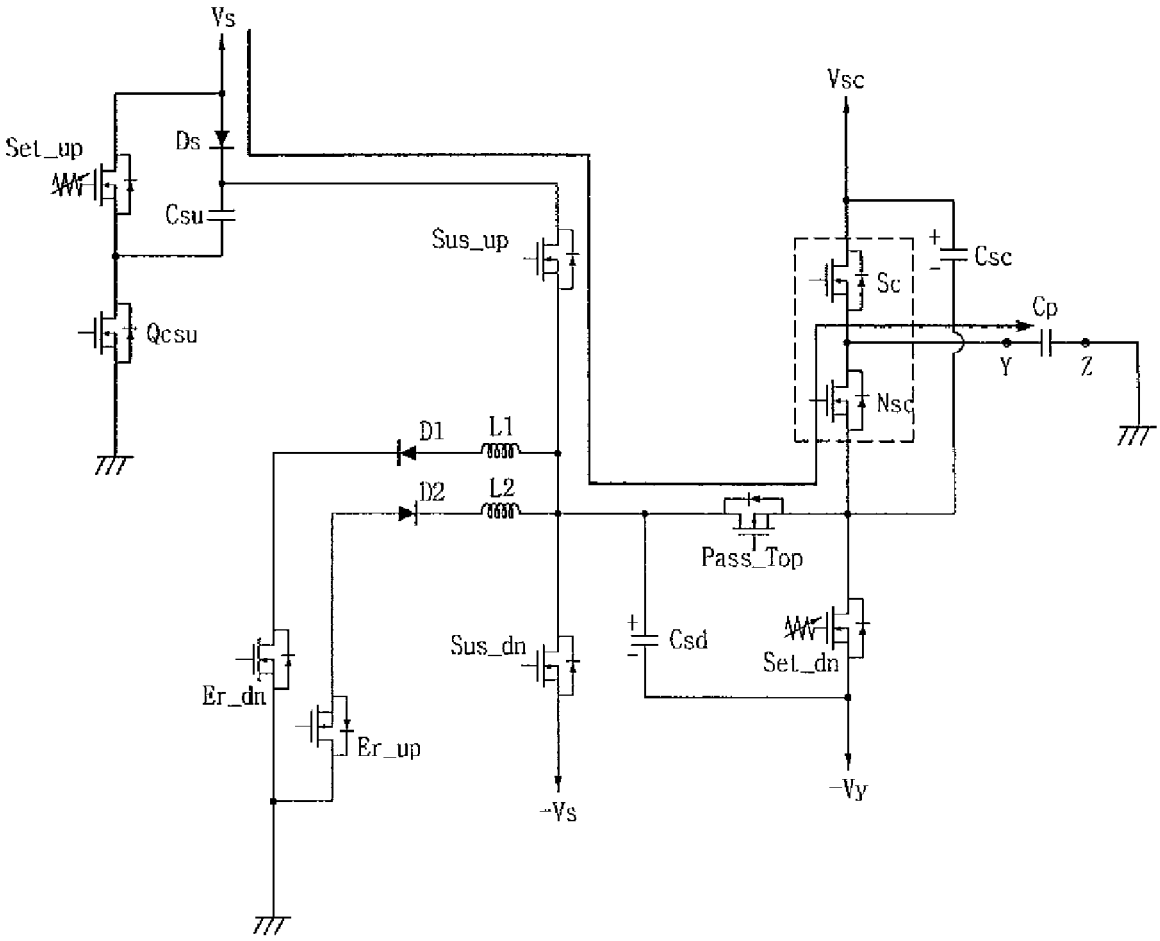

While the negative polarity sustain voltage −Vs is supplied during the sustain period, the first sustain switch Sus_up is turned on. Accordingly, a current path as shown in FIG. 6*f* is formed to supply the positive polarity sustain voltage Vs to the first electrodes (Y).

Figure 6G:
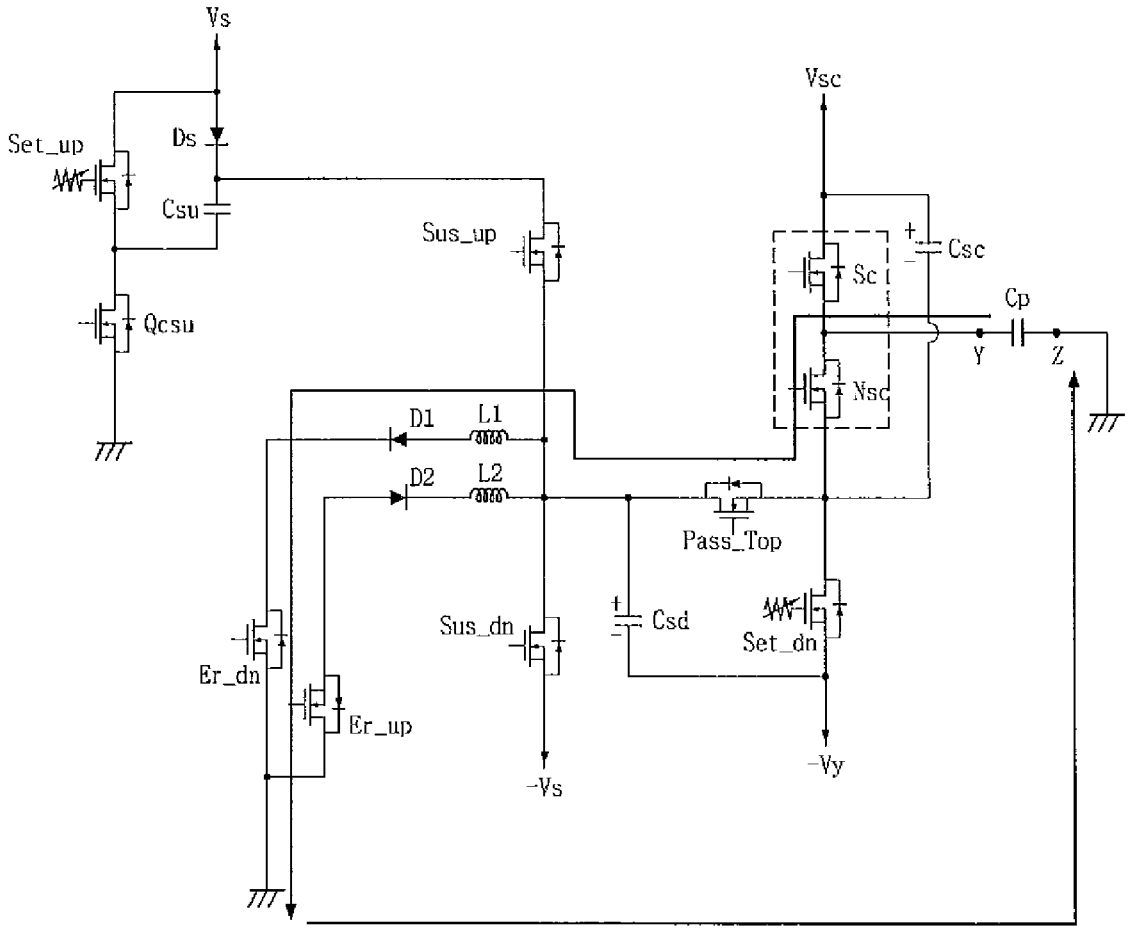

When the first resonance switch Er_dn is turned on, a current path as shown in FIG. 6*g* is formed, and the panel Cp and the first inductor L1 form resonance. Accordingly, the voltage of the first electrodes (Y) falls from the positive polarity sustain voltage Vs to the negative polarity sustain voltage −Vs during the sustain period. Namely, because the voltage of the first electrodes (Y) is supplied to the second electrodes (Z) via the first reference voltage source 140, the voltage of the first electrodes (Y) and that of the second electrodes (Z) are inverted. Thus, the voltage of the first electrodes (Y) falls from the positive polarity sustain voltage +Vs to the negative polarity sustain voltage −Vs based on the first reference voltage source 140.

Figure 6H:
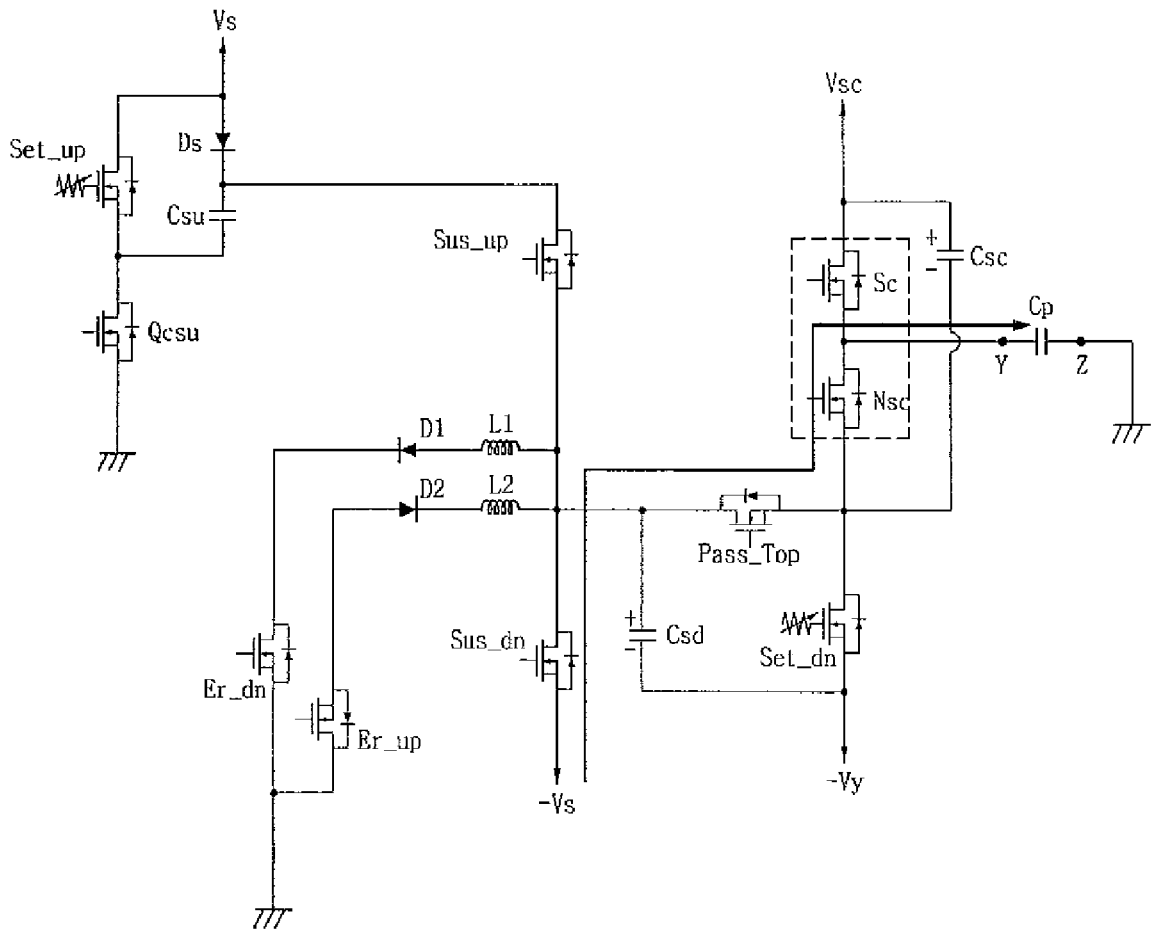

When the second sustain switch Sus_dn is turned on, a current path as shown in FIG. 6*h* is formed, along which the negative polarity sustain voltage −Vs is supplied to the first electrodes (Y).

Figure 6I:
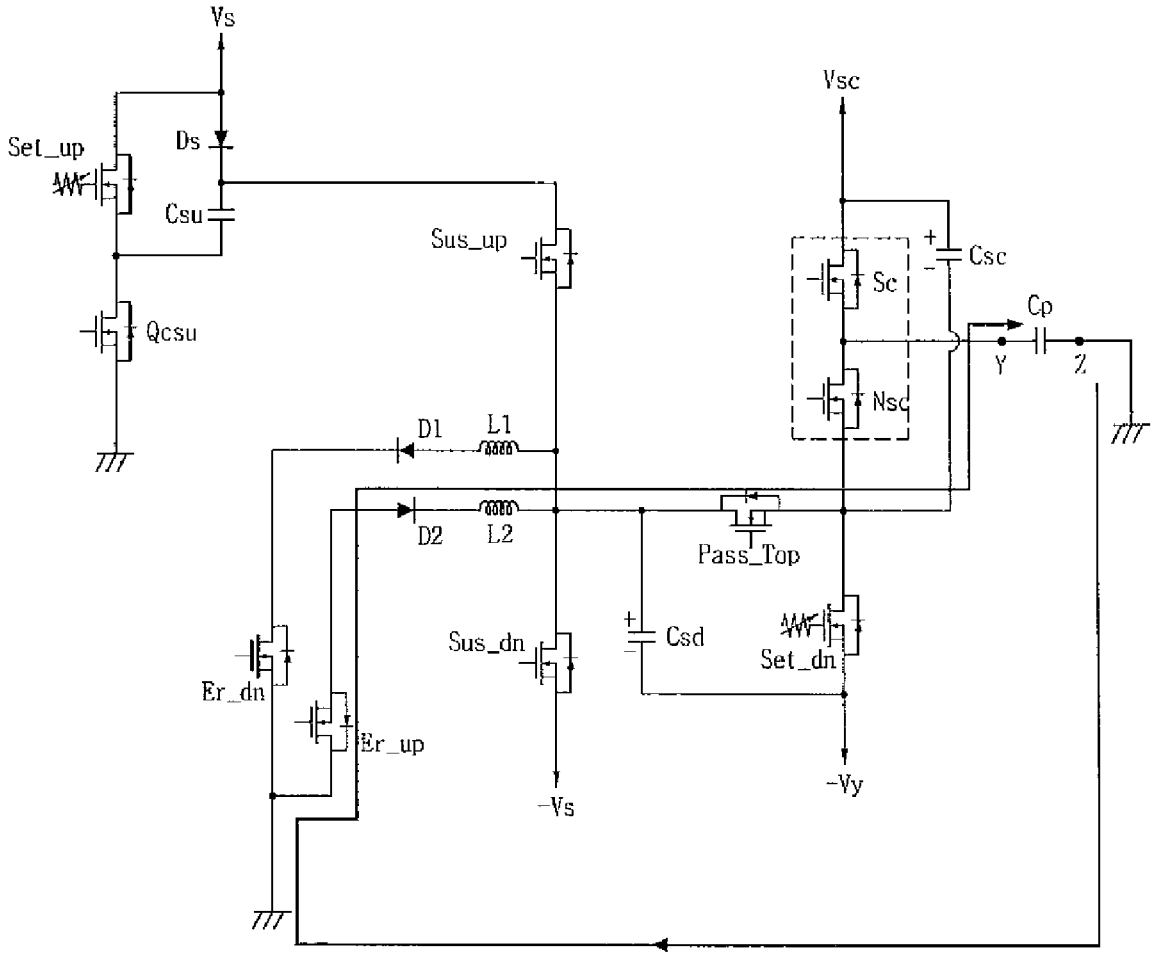

When the second resonance switch Er_up is turned on, a current path as shown in FIG. 6*i* is formed. Accordingly, the voltage of the first electrodes (Y) rises from the negative polarity sustain voltage −Vs to the positive polarity sustain voltage +Vs. The voltage of the second electrodes (Z) is supplied to the first electrodes (Y) via the second inductor L2 and the first reference voltage source 140. Because the panel Cp and the second inductor L2 form resonance, the voltage of the first electrodes (Y) and that of the second electrodes (Z) are inverted.

Figure 7:
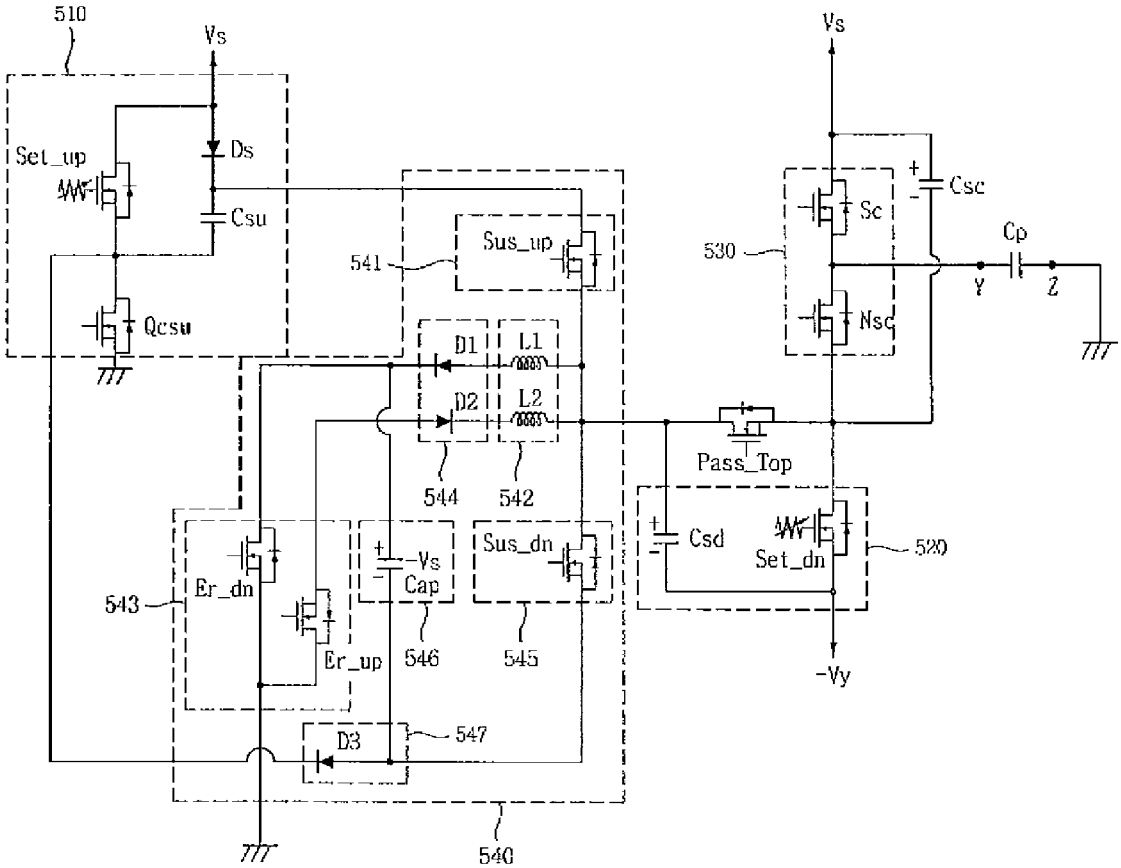
FIG. 7 is a view illustrating an example of the first driver comprising an energy storage unit that forms a negative polarity constant voltage source in FIG. 5.

As shown in FIG. 5, both the positive polarity sustain voltage source Vs and the negative polarity sustain voltage source −Vs are used, but as shown in FIG. 7, both the positive polarity sustain voltage and the negative polarity sustain voltage can be formed only with the positive polarity sustain voltage source Vs.

As shown in FIG. 7, the sustain driver 540 of the first driver 110 comprises an energy storage unit 546 that forms the negative polarity sustain constant voltage source −Vs and a voltage maintaining unit 547 that blocks a reverse current to maintain the voltage charged in the energy storage unit 546.

The energy storage unit 546 comprises a capacitor −Vs Cap. One end of the capacitor −Vs Cap is connected with a cathode of the first blocking diode D1 and the other end thereof is commonly connected with a third diode D3 of the voltage maintaining unit 547 and the second sustain switch Sus_dn.

When the first sustain switch Sus_up is turned on, the capacitor −Vs Cap charges voltages supplied from the positive polarity sustain constant voltage source Vs. Thereafter, when the second sustain switch Sus_dn is turned on, the negative polarity sustain voltage −Vs formed at the other end of the capacitor −Vs Cap is supplied to the first electrodes (Y).

The voltage maintaining unit comprises the third diode D3. One end of the third diode D3 is commonly connected with the capacitor −Vs Cap and the second sustain switch Sus_dn, and the other end thereof is connected with the set-up charge switch Qcsu. Alternatively, the other end of the third diode D3 may be connected with the first reference voltage source 140.

The third diode D3 blocks a reverse current during the following three periods: During a period while the first sustain switch Sus_up is turned on so that the voltages are charged in the capacitor −Vs Cap and the voltage of the first electrodes (Y) is maintained at the positive polarity sustain voltage +Vs; during a period while the voltage of the first electrodes (Y) falls from the positive polarity sustain voltage +Vs to the negative polarity sustain voltage −Vs or rises from the negative polarity sustain voltage −Vs to the positive polarity sustain voltage +Vs according to the resonance between the panel Cp and the inductor unit 54; and during a period while the second sustain switch Sus_dn is turned on to maintain the voltage of the first electrodes (Y) at the negative polarity sustain voltage −Vs. During these three periods, the third diode D3 blocks a reverse current to prevent formation of a current path from the first reference voltage source 140 to the other end of the capacitor −Vs Cap to thus maintain the voltage charged in the capacitor −Vs Cap.

Figure 8A:
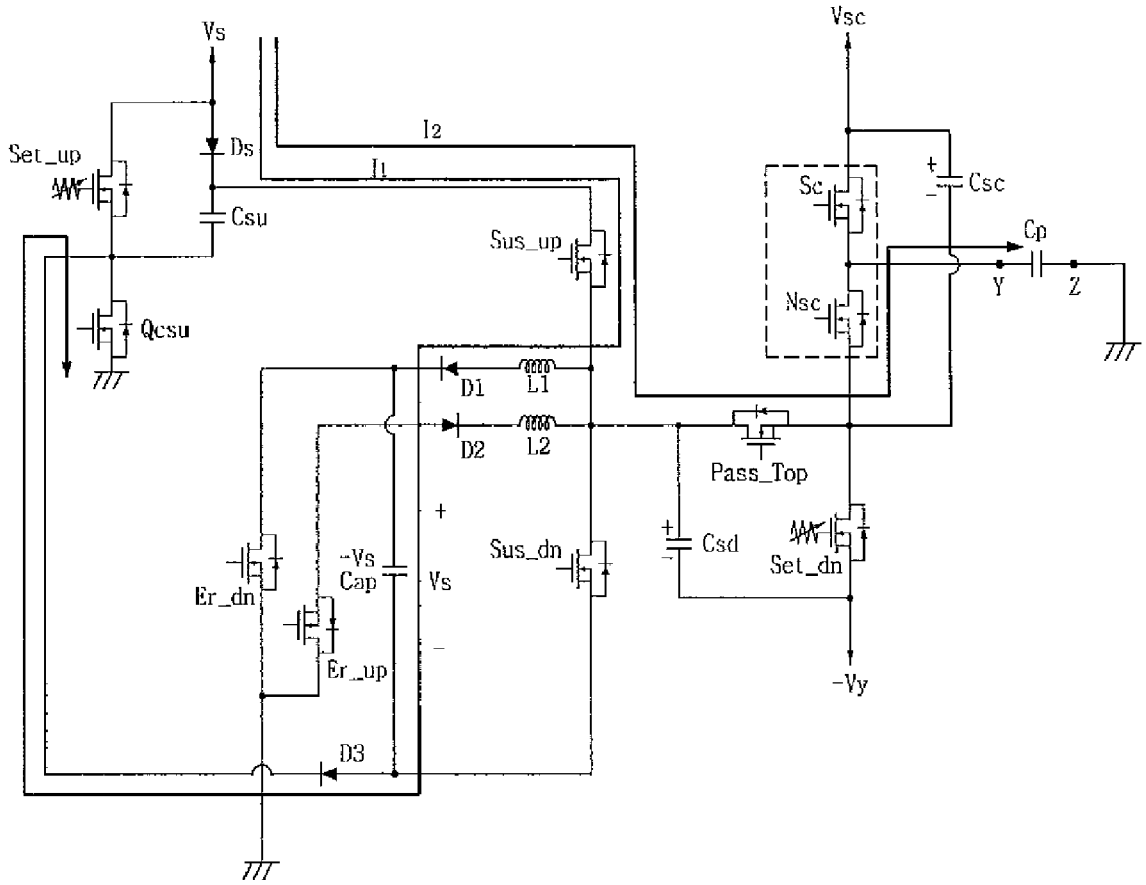
FIGS. 8*a* and 8*b* are views illustrating an example of the method for driving the first driver in FIG. 7.

When the first sustain switch Sus_up is turned on, first and second current paths I1 and I2 as shown in FIG. 8*a* are formed. As the second current path I2 is formed, the positive polarity sustain voltage +Vs is supplied to the first electrodes (Y). In addition, the positive polarity sustain voltage Vs is charged in the capacitor −Vs Cap by the first current path I1. Accordingly, the voltage between both ends of the capacitor −Vs Cap is substantially the same as the size of the positive polarity sustain voltage +Vs.

Figure 8B:
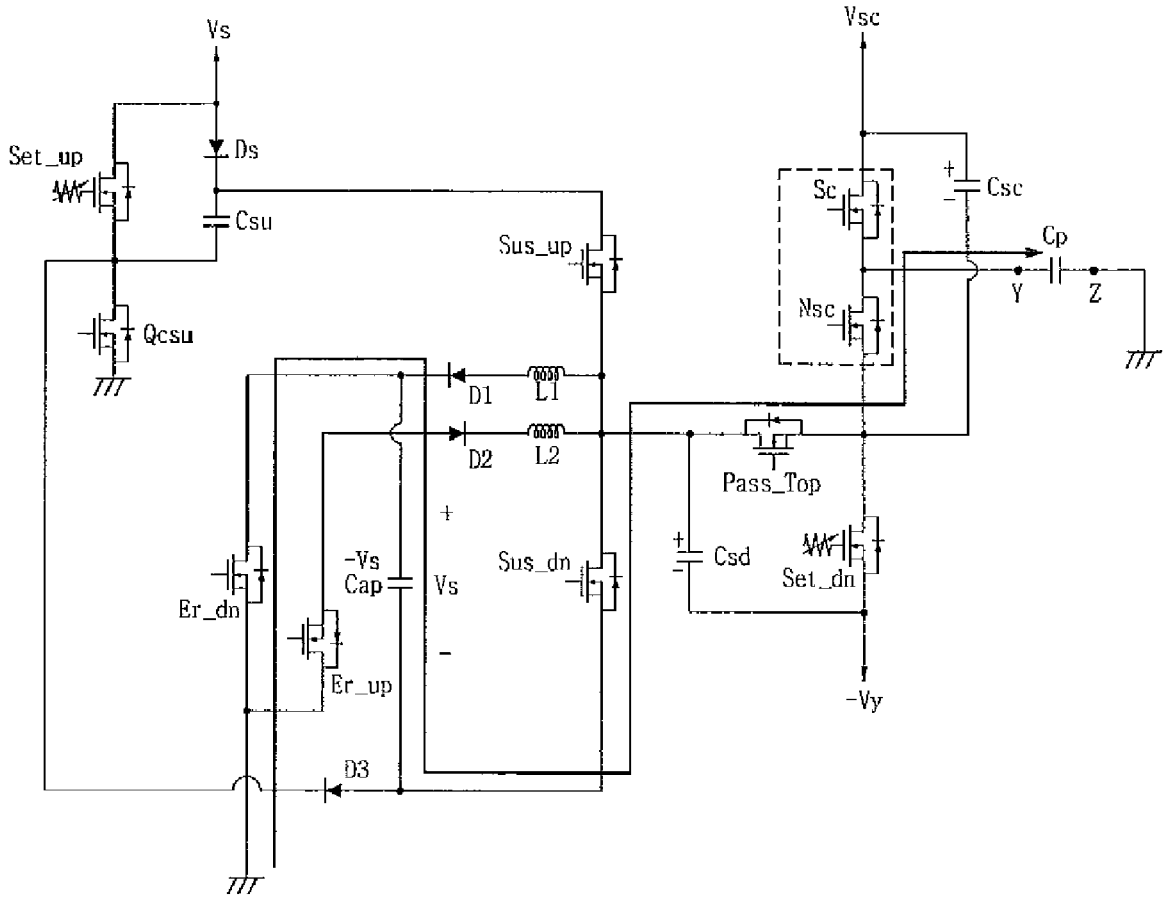

When the second sustain switch Sus_dn is turned on, a current path as shown in FIG. 8*b* is formed. Due to the current path as shown in FIG. 8*b*, the voltage at one end of the capacitor −Vs Cap connected with the cathode of the first blocking diode D1 is substantially the same as that of the first reference voltage source 140. Also, because a difference between voltages of the both ends of the capacitor −Vs Cap should be maintained at the positive polarity sustain voltage +Vs, the voltage at the other end of the capacitor −Vs Cap is the negative polarity sustain voltage −Vs based on the first reference voltage source 140. Accordingly, the negative polarity sustain voltage −Vs is supplied to the first electrodes (Y). In this case, because the negative polarity sustain voltage −Vs is supplied without using any additional negative polarity sustain constant voltage source, the production cost of the plasma display apparatus can be reduced.

The first sustain controller 541, the inductor unit 542, the resonance controller 543, the reverse current blocking unit 544, and the second sustain controller 545 are the same as those described above with reference to FIGS. 5 and 6*a* to 6*i*, so descriptions therefor will be omitted.

Figure 9A:
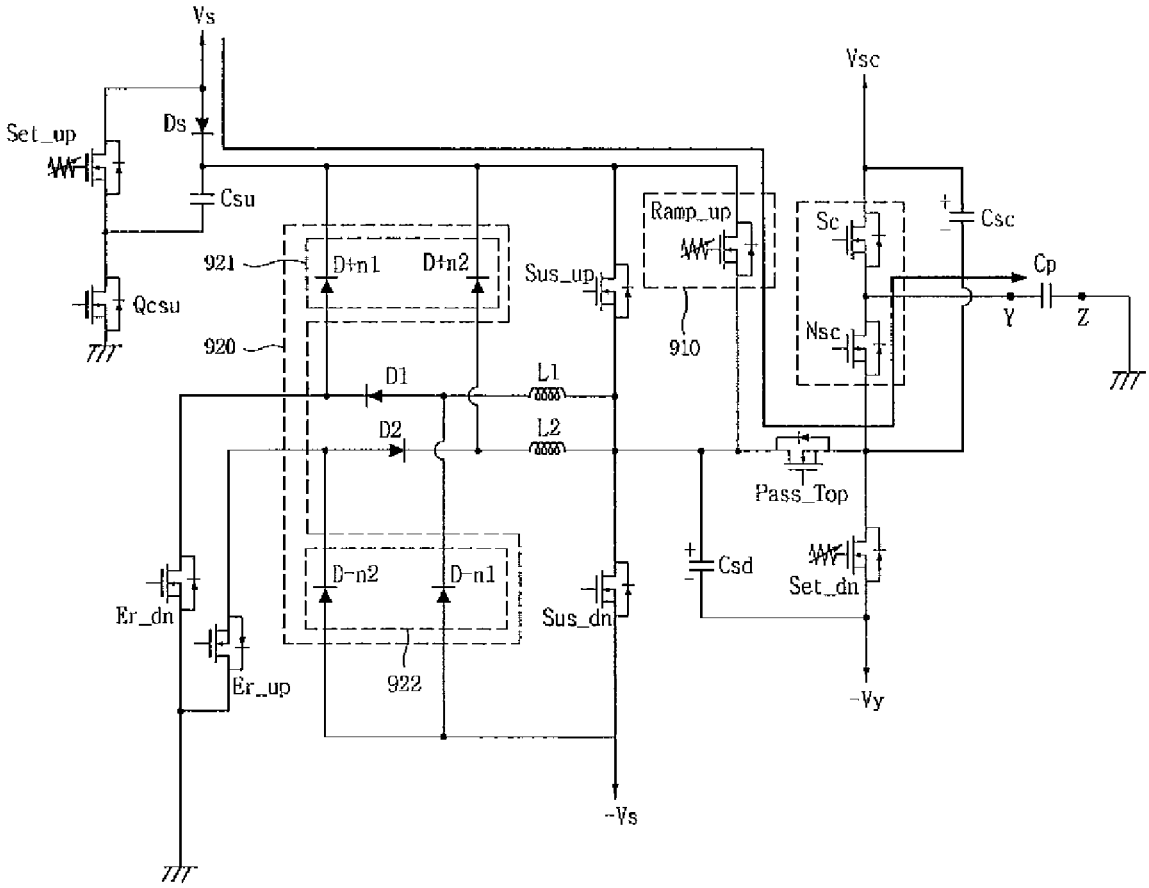
FIGS. 9*a* to 9*c* are views illustrating an example of the first driver comprising a pre-set-up controller and a noise canceling unit in FIG. 5.

With reference to FIG. 9*a*, the first driver 110 in FIG. 5 further comprises a pre-set-up controller 910 and a noise canceling unit 920.

The pre-set-up controller 910 comprises a pre-set-up switch Ramp_up. One end of the pre-set-up switch Ramp_up is commonly connected with one end of the first sustain switch Sus_up, the set-up diode Ds, and the set-up capacitor Csu, and the other end of the pre-set-up switch Ramp_up is commonly connected with the other end of the first sustain switch Sus_up, the first inductor L1, the second inductor L2, and the second sustain switch Sus_dn.

Figure 9B:
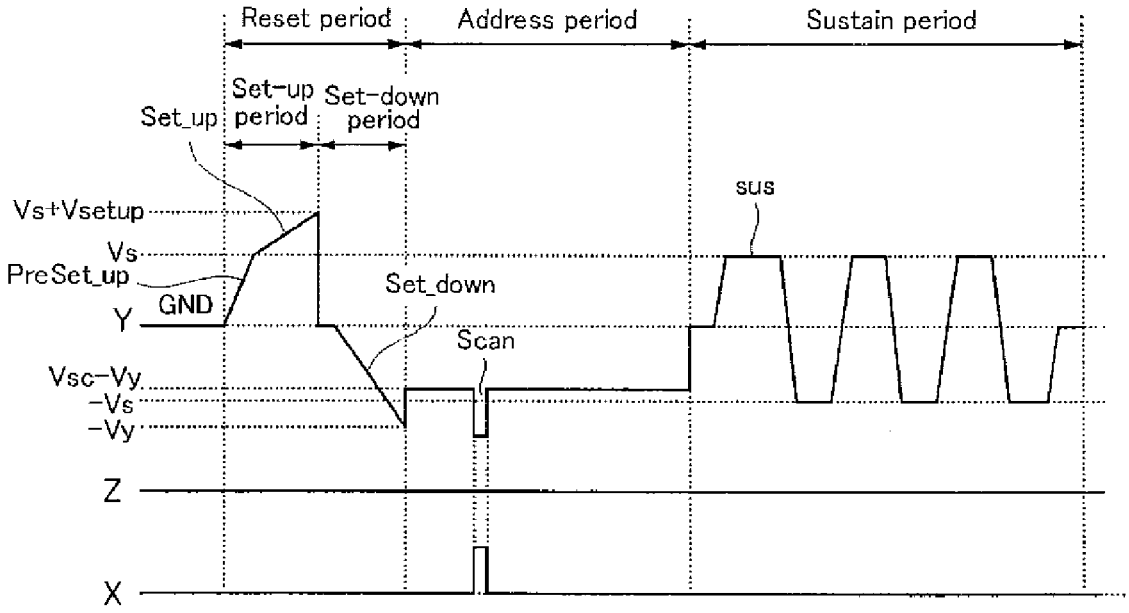

When the pre-set-up switch Ramp_up of the pre-set-up controller 910 is turned on, a current path as shown in FIG. 9*a* is formed. As the current path as shown in FIG. 9*a* is formed, a pre-set-up signal PreSet_up that gradually rises from a first reference voltage to the positive polarity sustain voltage level +Vs is supplied to the first electrodes (Y). Accordingly, the pre-set-up signal PreSet_up that gradually rises from the first reference voltage level to the positive polarity sustain voltage +Vs level is supplied to the first electrodes (Y) during the set-up period of the reset period as shown in FIG. 9*b*.

When the pre-set-up signal PreSet_up is supplied, because it gradually rises from the first reference voltage to the positive polarity sustain voltage +Vs, the strength of discharges can be relatively reduced and thus the contrast ratio can be improved.

The noise canceling unit 920 as shown in FIG. 9*a* comprises a positive polarity noise canceller 921 that removes a portion of the voltage of the first electrodes (Y) which is higher than the positive polarity sustain voltage +Vs during the sustain period and a negative polarity noise canceller 922 that removes a portion of the voltage of the first electrodes (Y) which is lower than the negative polarity sustain voltage −Vs.

The positive polarity noise canceller 921 comprises first and second positive polarity diodes D+n1 and D+n2. An anode of the first positive polarity diode D+n1 is electrically connected with the cathode of the first blocking diode D1, and a cathode of the first positive polarity diode D+n1 is commonly connected with the set-up capacitor Csu, the set-up diode Ds, the first sustain switch Sus_up, and the pre-set-up switch Ramp_up.

Figure 9C:
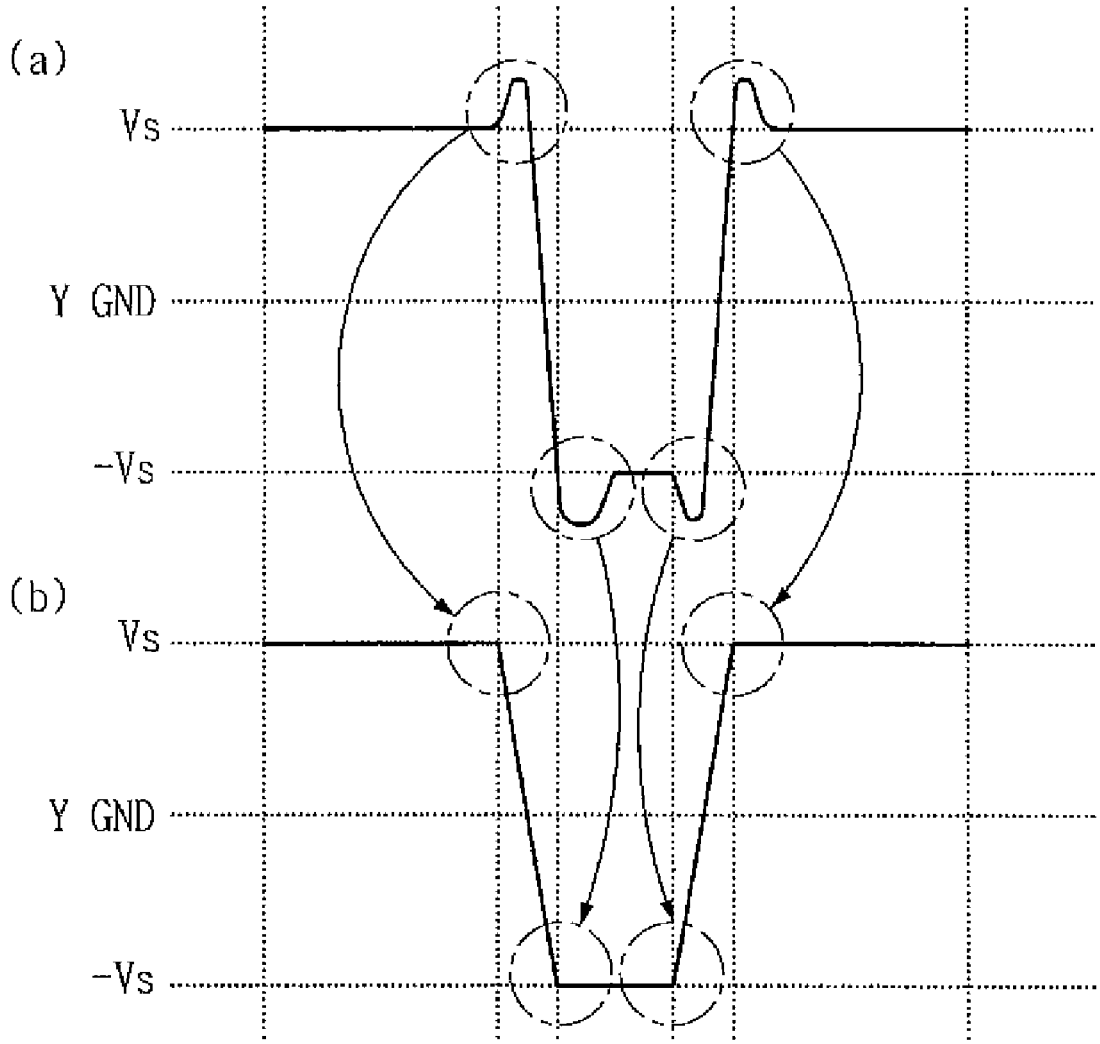

As for the first positive polarity diode D+n1, when the voltage of the first electrodes (Y) falls from the positive polarity sustain voltage +Vs to the negative polarity sustain voltage −Vs, a counter electromotive force as shown by (a) in FIG. 9*c* is instantaneously generated at the inductor, making the voltage of the first electrodes (Y) rise. The first positive polarity diode D+n1 is forwardly biased when the voltage of the first electrodes (Y) is instantaneously higher than the positive polarity sustain voltage Vs to clamp the voltage of the first electrodes (Y) which is higher than the positive polarity sustain voltage Vs as shown by (b) in FIG. 9*c*.

An anode of the second positive polarity diode D+n2 is electrically connected with a cathode of the second blocking diode D2, and a cathode of the second positive polarity diode D+n2 is commonly connected with the set-up capacitor Csu, the set-up diode Ds, the first sustain switch Sus_up, and the pre-set-up switch Ramp_up.

As for the second positive polarity diode D+n2, when the voltage of the first electrodes (Y) rises from the negative polarity sustain voltage −Vs to the positive polarity sustain voltage +Vs, it rises instantaneously due to a counter electromotive force generated from the inductor as shown by (a) in FIG. 9. The second positive polarity diode D+n2 clamps the voltage higher than the positive polarity sustain voltage +Vs as shown by (b) in FIG. 9*c*.

The negative polarity noise canceller 922 comprises first and second positive polarity diodes D−n1 and D−n2. A cathode of the first negative polarity diode D−n1 is electrically connected with an anode of the first blocking diode D1, and an anode of the first negative polarity diode D−n1 is commonly connected with the second sustain switch Sus_dn and the negative polarity sustain constant voltage source −Vs.

As for the first negative polarity diode D−n1, as shown by (a) in FIG. 9*c*, when the voltage of the first electrodes (Y) falls from the positive polarity sustain voltage +Vs to the negative polarity sustain voltage −Vs, it falls to be lower than the negative polarity sustain voltage −Vs due to the inductor that tries to maintain the flowing of the current. The first negative polarity diode D−n1 clamps the voltage of the first electrodes (Y) which is lower than the negative polarity sustain voltage −Vs as shown by (b) in FIG. 9*c*.

A cathode of the second negative polarity diode D−n2 is electrically connected with the second blocking diode D2, and an anode of the second negative polarity diode D−n2 is commonly connected with the second sustain switch Sus_dn and the negative polarity sustain constant voltage source −Vs.

As for the second positive polarity diode D+n2, as shown by (a) IN FIG. 9*c*, when the voltage of the first electrodes (Y) rises from the negative polarity sustain voltage −Vs to the positive polarity sustain voltage +Vs, the counter electromotive force is instantaneously generated at the inductor, making the voltage of the first electrodes (Y) fall. The second negative polarity diode D−n2 clamps the voltage lower than the negative polarity sustain voltage −Vs as shown by (b) in FIG. 9*c*.

Accordingly, the noise canceling unit 920 improves the drive characteristics of the circuitry and allows the sustain drive to be stably driven. In addition, because stable drive signals are supplied to the PDP 100, discharge characteristics of the PDP 100 can be enhanced.

Figure 10:
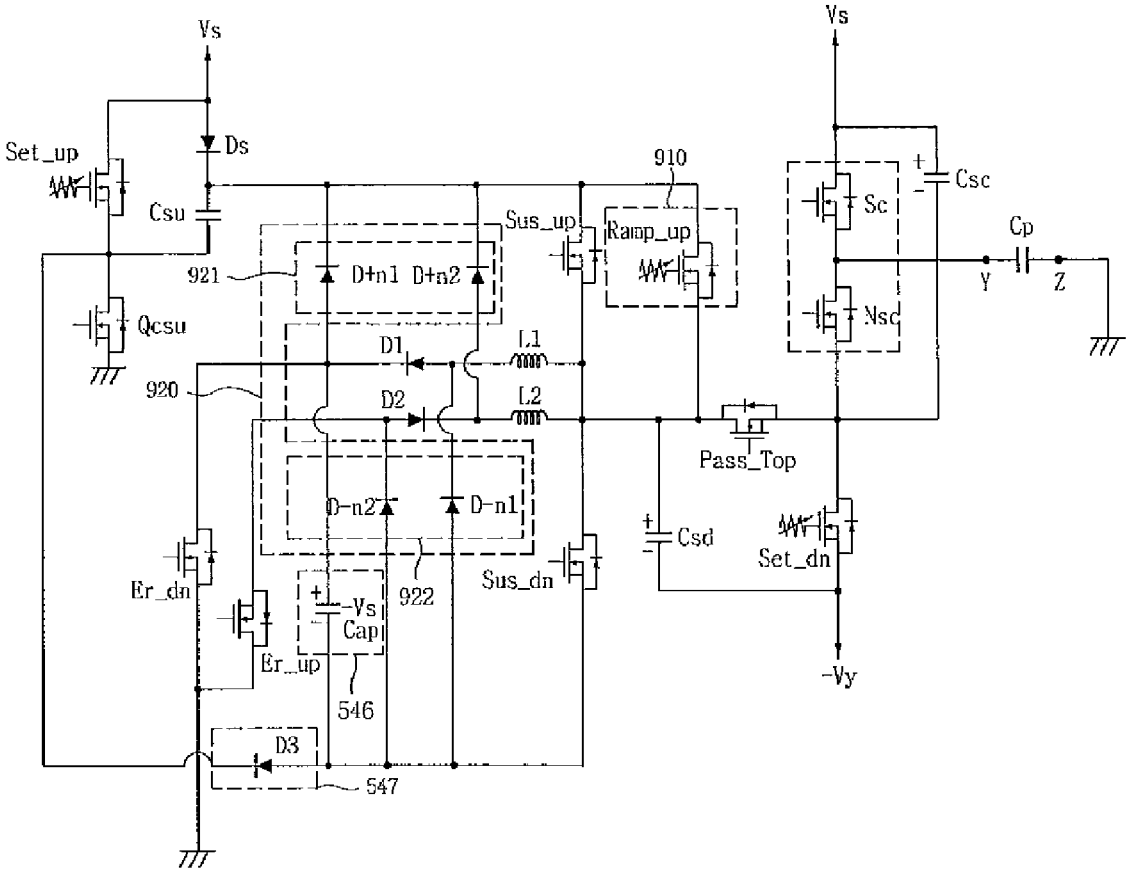
FIG. 10 is a view illustrating an example of the first driver comprising an energy storage unit that forms a negative polarity constant voltage source in FIG. 9*a*.

As shown in FIG. 10, the first driver 110 may comprise the energy storage unit 546, the voltage maintaining unit 547, the pre-set-up controller 910, and the nose canceling unit 920.

The number of the constant voltage sources can be reduced by virtue of the energy storage unit 546. The pre-set-up controller 910 contributes to improve the contrast ratio. The noise canceling unit 920 leads to improvement of the drive characteristics of the circuits and allows the sustain voltage to be stably supplied to the panel, improving the discharge characteristics of the panel.

Herein, the connection relationship and driving method of the energy storage unit 546 and the voltage maintaining unit 547 are the same as those with reference to FIGS. 7, 8*a*, and 8*b*, so descriptions therefor will be omitted.

Also, a connection relationship and driving method of the pre-set-up controller 910 and the noise canceling unit 920 are the same as those with reference to FIGS. 9*a* to 9*c*, so descriptions therefor will be omitted.

A connection relationship of the energy storage unit 546 and the noise canceling unit 920 is as follows.

An anode of the first positive polarity diode D+n1 in the positive polarity noise canceling unit 920 is connected with one end of the capacitor −Vs Cap to which the positive polarity sustain voltage +Vs is supplied in the energy storage unit 546, and the anodes of the first and second negative polarity diode D−n1 and D−n2 are connected with the other end of the capacitor −Vs Cap where the negative polarity sustain voltage −Vs is formed in the energy storage unit 546, whereby the voltage of the first electrodes (Y) is prevented from falling to be lower than the negative polarity sustain voltage −Vs.

Figure 11:
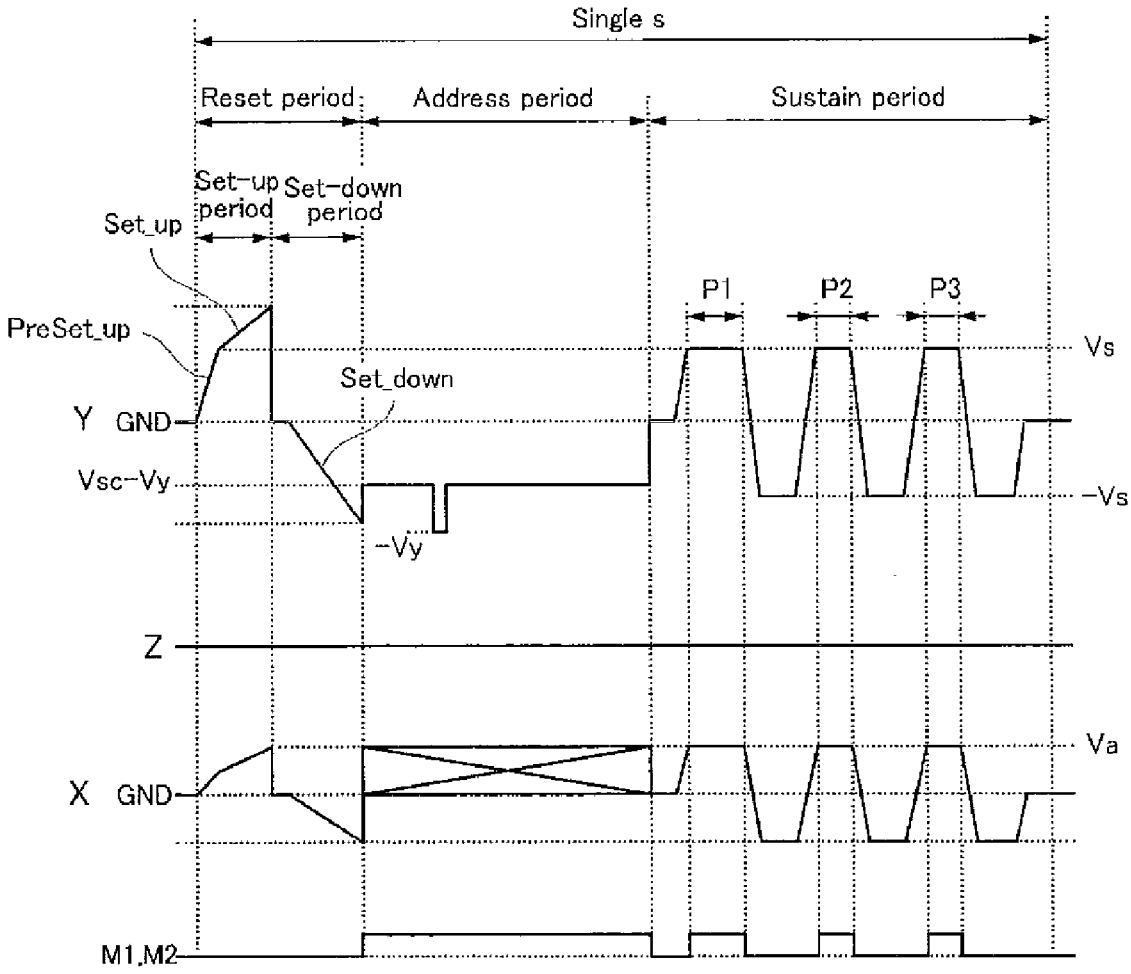
FIG. 11 is a view illustrating an example of a method for driving the PDP of the plasma display apparatus comprising the first driver in FIG. 10.

As shown in FIG. 11, when the reference separation switches M1 and M2 of the reference separation controller 130 are turned off, the first and second reference voltage sources 140 and 150 may be electrically separated during at least one of the reset period and the address period of the sub-field.

For example, when the reference separation switches M1 and M2 of the reference separation controller 130 are turned off during the reset period of the subfield, the first and second reference voltage sources 140 and 150 may be separated. With the first and second reference voltage sources 140 and 150 separated, the third electrodes (X) falls into the floating state, so damage of the phosphors disposed on the third electrodes (X) can be minimized. Namely, when the reset signal is supplied to the first electrodes (Y), a signal similar to the reset signal is also formed at the third electrodes (X) in the floating state. The facing discharge weakens by the signal formed at the third electrodes (X), minimizing damage of the phosphors.

In addition, the reference separation switches M1 and M2 of the reference separation controller 130 are turned on during periods P1, P2, and P3 while the positive polarity sustain voltage +Vs is supplied, among the address period and the sustain period of the subfield. Accordingly, the first and second reference voltage sources 140 and 150 are connected. During the periods P1, P2, and P3, the second driver 120 in FIG. 4 supplies the data voltage Va.

The reference separation switches M1 and M2 of the reference separation controller 130 are turned off during the other remaining sustain period, excluding the periods P1, P2, and P3 during which the positive polarity sustain voltage +Vs is supplied by the first driver 100 in FIG. 4, so the first and second reference voltage sources 140 and 150 are electrically separated.

When the first and second voltage sources 140 and 150 are separated, the third electrodes (X) falls into the floating state. Accordingly, the voltage of the third electrodes (X) is affected by the signal supplied to the first electrodes (Y), so the signal similar to the signal supplied to the first electrodes (Y) is formed at the third electrodes (X).

That is, when a voltage that gradually rises from the negative polarity voltage of the ground level to the positive polarity sustain voltage Vs is supplied to the first electrodes (Y), a voltage that gradually rises to the data voltage Va is formed at the third electrodes (X). In addition, when a voltage that gradually falls from the positive polarity sustain voltage Vs to the negative polarity sustain voltage −Va is supplied to the first electrodes (Y), a voltage that gradually falls to the data voltage Va is formed at the third electrodes (X).

Therefore, by making the third electrodes (X) float, the influence on the voltage change can be minimized. Namely, the facing discharge can be reduced by reducing the size of the counter voltages between the third electrodes (X) and the first electrodes (Y). In addition, a stable surface discharge can be generated, and the contrast characteristics can be improved by lowering black luminance during the reset period. Moreover, the life span of the phosphors can be improved by preventing damage of the third electrodes (X), and formation of a residual image can be minimized.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112 (6).

What is claimed is:

1. A plasma display apparatus comprising:

a plasma display panel including a first electrode, a second electrode and a third electrode crossing the first electrode and the second electrode;

a sustain driver supplying a sustain signal swinging between a positive polarity sustain voltage and a negative polarity sustain voltage to the first electrode during a sustain period;

a data driver supplying a data signal to the third electrode during an address period; and a reference separation controller controlling a first reference voltage source, which is connected with the sustain driver and the second electrode commonly, separated from or connected with a second reference voltage source which is connected with the data driver, wherein the sustain driver further comprises a capacitor, and the negative polarity sustain voltage is formed at the other end of the capacitor after the positive polarity sustain voltage is charged in the capacitor through an end of the capacitor.

2. The plasma display apparatus of claim 1, wherein the reference separation controller connects the first reference voltage source and the second reference voltage source during a period when the positive polarity sustain voltage is supplied to the first electrode, and separates the first reference voltage source and the second reference voltage source during the rest period except for the period when the positive polarity sustain voltage is supplied to the first electrode.

3. The plasma display apparatus of claim 2, wherein when the reference separation controller separates, the third electrode falls into a floating state.

4. The plasma display apparatus of claim 1, wherein the sustain driver includes an energy storage unit for charging a voltage, a first sustain controller supplying the positive polarity sustain voltage to an end of the capacitor and the first electrode, a voltage maintaining unit blocking a reverse current to maintain the voltage charged in the capacitor, an inductor unit forming a resonance with the plasma display panel, a resonance controller controlling a voltage of the first electrode to rise from the positive polarity sustain voltage to the negative polarity sustain voltage or to fall from the negative polarity sustain voltage to the positive polarity sustain voltage through the resonance of the plasma display panel and the inductor unit, a second sustain controller supplying the negative polarity sustain voltage formed at the other end of the capacitor to the first electrode, and a reverse current blocking unit electrically connected with the inductor unit and the resonance controller and blocking a reverse current.

5. The plasma display apparatus of claim 4, wherein the resonance controller includes a first resonance switch controlling a voltage of the first electrode to fall from the positive polarity sustain voltage to the negative polarity sustain voltage, and a second resonance switch controlling the voltage of the first electrode to rise from the negative polarity sustain voltage to the positive polarity sustain voltage.

6. The plasma display apparatus of claim 5, wherein the inductor unit includes a first inductor forming the resonance with the plasma display panel that the voltage of the first electrode falls from the positive polarity sustain voltage to the negative polarity sustain voltage, and a second inductor forming the resonance with the plasma display panel that the voltage of the first electrode rises from the positive polarity sustain voltage to the negative polarity sustain voltage.

7. The plasma display apparatus of claim 6, wherein the reverse current blocking unit a first blocking diode blocking a current flowing from the first resonance switch to the first inductor, and a second blocking diode blocking a current flowing from the second inductor to the second resonance switch.

8. The plasma display apparatus of claim 4, further comprises a set-up controller supplying a set-up signal rising from the positive polarity sustain voltage to the first electrode during a reset period, and a pre-set-up controller supplying a pre-set-up signal gradually rising from a reference voltage to the positive sustain voltage to the first electrode before the supply of the set-up signal.

9. The plasma display apparatus of claim 1, further comprises a noise canceling unit during the sustain period canceling a voltage lower than the negative polarity sustain voltage or a voltage higher than the positive polarity sustain voltage during the sustain period.

10. The plasma display apparatus of claim 9, wherein the noise canceling unit comprises a first positive polarity diode clamping the voltage higher than the positive polarity sustain voltage when the voltage of the first electrode falls from the positive polarity sustain voltage to the negative polarity sustain voltage, and a second positive polarity diode clamping the voltage higher than the positive polarity sustain voltage when the voltage of the first electrode rises from the negative polarity sustain voltage to the positive polarity sustain voltage.

11. The plasma display apparatus of claim 9, wherein the noise canceling unit comprises a first negative polarity diode clamping the voltage lower than the negative polarity sustain voltage when the voltage of the first electrode falls from the positive polarity sustain voltage to the negative polarity sustain voltage, and a second negative polarity diode clamping the voltage lower than the negative polarity sustain voltage when the voltage of the first electrode rises from the negative polarity sustain voltage to the positive polarity sustain voltage.

* * * * *